US008453729B2

(12) United States Patent
Harris et al.

(10) Patent No.: US 8,453,729 B2
(45) Date of Patent: Jun. 4, 2013

(54) HYDRAULIC SETTING ASSEMBLY

(75) Inventors: Michael J. Harris, Houston, TX (US); Martin Alfred Stulberg, Angleton, TX (US)

(73) Assignee: Key Energy Services, LLC, Houston, TX (US)

( * ) Notice: Subject to any disclaimer, the term of this patent is extended or adjusted under 35 U.S.C. 154(b) by 264 days.

(21) Appl. No.: 12/658,226

(22) Filed: Feb. 4, 2010

(65) Prior Publication Data

US 2010/0252252 A1 Oct. 7, 2010

Related U.S. Application Data

(63) Continuation-in-part of application No. 12/592,026, filed on Nov. 19, 2009.

(60) Provisional application No. 61/166,169, filed on Apr. 2, 2009.

(51) Int. Cl.
*E21B 22/00* (2010.01)

(52) U.S. Cl.
USPC ..... 166/212; 166/120; 166/122; 166/129

(58) Field of Classification Search
USPC ..... 166/212, 120, 122, 129, 216, 217, 166/123
See application file for complete search history.

(56) References Cited

U.S. PATENT DOCUMENTS 3,712,376 A 1/1973 Owen et al.
3,776,307 A 12/1973 Young (Continued)

FOREIGN PATENT DOCUMENTS

EP 0454466 A2 10/1991
EP 0539020 B1 4/1993

(Continued)

OTHER PUBLICATIONS

PCT International Search Report and Written Opinion, Dec. 9, 2010, Int'l Application No. PCT/US2010/000911, European Patent Office (International Searching Authority), Patrizia Lindquist (Authorized Officer) (17 pp).

(Continued)

*Primary Examiner* — William P Neuder
*Assistant Examiner* — Ronald Runyan
(74) *Attorney, Agent, or Firm* — Keith B. Willhelm

(57) ABSTRACT

Novel hydraulic actuators and hydraulic setting assemblies are provided for use in downhole, oil and gas well tools. The novel hydraulic actuators include a cylindrical mandrel and an annular stationary sealing member connected to the mandrel. A hydraulic cylinder is slidably supported on the mandrel and stationary sealing member and is releasably fixed in position on the mandrel. The stationary sealing member divides the interior of the cylinder into a bottom hydraulic chamber and a top hydraulic chamber. An inlet port provides fluid communication into the bottom hydraulic chamber, and an outlet port provides fluid communication into the top hydraulic chamber. A balance piston is slidably supported within the top hydraulic chamber of the actuator. The piston includes an axially extending passageway. Fluid communication through the piston and between its upper and lower sides is controlled by a normally shut valve in the passageway. In the absence of relative movement between the mandrel and cylinder, the balance piston is able to slide in response to a difference in hydrostatic pressure between the outlet port, is which is on one side of the piston, and the portion of the top hydraulic chamber that is on the bottom side of the piston.

31 Claims, 11 Drawing Sheets

U.S. PATENT DOCUMENTS

| | | | | |
|---|---|---|---|---|
| 3,821,962 | A | 7/1974 | Mott | |
| 3,948,321 | A | 4/1976 | Owen et al. | |
| 4,320,800 | A | 3/1982 | Upchurch | |
| 4,424,860 | A | 1/1984 | McGill | |
| 4,460,040 | A | 7/1984 | Bowyer | |
| 4,595,060 | A | 6/1986 | Beck | 166/373 |
| 4,950,844 | A | 8/1990 | Hallmark | |
| 5,009,002 | A | 4/1991 | Kelly | |
| 5,062,199 | A | 11/1991 | Kelly | |
| 5,156,210 | A | 10/1992 | Roth | |
| 5,180,015 | A * | 1/1993 | Ringgenberg et al. | 166/386 |
| 5,181,570 | A | 1/1993 | Allwin et al. | |
| 5,333,692 | A | 8/1994 | Baugh et al. | 166/387 |
| 5,413,173 | A | 5/1995 | Mills et al. | |
| 5,511,620 | A | 4/1996 | Baugh et al. | 166/387 |
| 5,553,672 | A | 9/1996 | Smith, Jr. et al. | |
| 5,564,501 | A | 10/1996 | Strattan et al. | |
| 5,686,369 | A | 11/1997 | Chen et al. | |
| 5,832,996 | A | 11/1998 | Carmody et al. | |
| 6,102,117 | A | 8/2000 | Swor et al. | |
| 6,112,811 | A | 9/2000 | Kilgore et al. | |
| 6,145,595 | A * | 11/2000 | Burris, II | 166/374 |
| 6,269,874 | B1 | 8/2001 | Rawson et al. | |
| 6,321,847 | B1 | 11/2001 | Brown | 166/374 |
| 6,354,372 | B1 | 3/2002 | Carisella et al. | |
| 6,446,724 | B2 | 9/2002 | Baugh et al. | 166/285 |
| 6,513,600 | B2 * | 2/2003 | Ross | 166/387 |
| 6,536,532 | B2 | 3/2003 | Doane | 166/387 |
| 6,561,271 | B2 | 5/2003 | Baugh et al. | 166/285 |
| 6,568,471 | B1 | 5/2003 | Cook et al. | 166/177.4 |
| 6,598,677 | B1 | 7/2003 | Baugh et al. | 166/285 |
| 6,622,789 | B1 | 9/2003 | Braddock | 166/277 |
| 6,631,765 | B2 | 10/2003 | Baugh et al. | 166/285 |
| 6,648,075 | B2 | 11/2003 | Badrak et al. | 166/381 |
| 6,666,276 | B1 | 12/2003 | Yokley et al. | 166/387 |
| 6,688,399 | B2 | 2/2004 | Maguire et al. | 166/382 |
| 6,691,788 | B1 | 2/2004 | Dearing | |
| 6,691,789 | B2 | 2/2004 | Jackson et al. | 166/384 |
| 6,705,615 | B2 | 3/2004 | Milberger et al. | 277/328 |
| 6,732,806 | B2 | 5/2004 | Mauldin et al. | 166/382 |
| 6,752,216 | B2 | 6/2004 | Coon | 166/387 |
| 6,761,221 | B1 | 7/2004 | Yokley et al. | 166/382 |
| 6,763,893 | B2 | 7/2004 | Braddick | 166/382 |
| 6,772,836 | B2 | 8/2004 | Schetky et al. | 166/277 |
| 6,782,953 | B2 | 8/2004 | Maguire et al. | 166/380 |
| 6,799,637 | B2 | 10/2004 | Schetky et al. | 166/384 |
| 6,808,024 | B2 | 10/2004 | Schwendemann et al. | |
| 6,814,143 | B2 | 11/2004 | Braddick | 166/277 |
| 6,817,409 | B2 | 11/2004 | Howard | |
| 6,857,473 | B2 | 2/2005 | Cook et al. | 166/212 |
| 6,880,632 | B2 | 4/2005 | Tom et al. | |
| 6,899,181 | B2 | 5/2005 | Simpson et al. | 166/380 |
| 6,915,852 | B2 | 7/2005 | Baugh et al. | 166/285 |
| 6,920,934 | B2 | 7/2005 | Badrak et al. | 166/381 |
| 6,920,935 | B2 | 7/2005 | Metcalfe | 166/382 |
| 6,923,261 | B2 | 8/2005 | Metcalfe et al. | 166/277 |
| 6,962,206 | B2 | 11/2005 | Herth et al. | 166/387 |
| 6,968,618 | B2 | 11/2005 | Cook et al. | 285/355 |
| 6,976,541 | B2 | 12/2005 | Brisco et al. | 166/382 |
| 6,997,252 | B2 | 2/2006 | Porter et al. | |
| 6,997,266 | B2 | 2/2006 | Jackson et al. | 166/384 |
| 7,021,390 | B2 | 4/2006 | Cook et al. | 166/384 |
| 7,028,780 | B2 | 4/2006 | Maguire | 166/382 |
| 7,032,679 | B2 | 4/2006 | Maguire et al. | 166/380 |
| 7,036,581 | B2 | 5/2006 | Trahan | 166/186 |
| 7,036,582 | B2 | 5/2006 | Cook et al. | 166/207 |
| 7,044,218 | B2 | 5/2006 | Cook et al. | 166/206 |
| 7,048,065 | B2 | 5/2006 | Badrak et al. | 166/382 |
| 7,077,213 | B2 | 7/2006 | Cook et al. | 166/384 |
| 7,093,656 | B2 | 8/2006 | Maguire | 166/277 |
| 7,114,573 | B2 | 10/2006 | Hirth et al. | 166/382 |
| 7,117,941 | B1 | 10/2006 | Gano et al. | 166/207 |
| 7,117,949 | B2 | 10/2006 | Doane et al. | |
| 7,117,957 | B2 | 10/2006 | Metcalfe et al. | 175/57 |
| 7,121,337 | B2 | 10/2006 | Cook et al. | 166/207 |
| 7,124,821 | B2 | 10/2006 | Metcalfe et al. | 166/277 |
| 7,124,827 | B2 | 10/2006 | Braddick | |
| 7,124,829 | B2 | 10/2006 | Braddick | 166/382 |
| 7,156,182 | B2 | 1/2007 | Lynde et al. | 166/382 |
| 7,165,622 | B2 | 1/2007 | Herth et al. | 166/387 |
| 7,168,496 | B2 | 1/2007 | Cook et al. | 166/380 |
| 7,172,021 | B2 | 2/2007 | Brisco et al. | 166/285 |
| 7,172,027 | B2 | 2/2007 | Simpson et al. | 166/382 |
| 7,222,669 | B2 | 5/2007 | Sonnier et al. | 166/206 |
| 7,225,880 | B2 | 6/2007 | Braddick | 166/382 |
| 7,231,985 | B2 | 6/2007 | Cook et al. | 166/380 |
| 7,240,728 | B2 | 7/2007 | Cook et al. | 166/207 |
| 7,240,729 | B2 | 7/2007 | Cook et al. | 166/207 |
| 7,246,667 | B2 | 7/2007 | Cook et al. | 166/380 |
| 7,258,168 | B2 | 8/2007 | Cook et al. | 166/277 |
| 7,278,492 | B2 | 10/2007 | Braddick | 166/382 |
| 7,303,020 | B2 | 12/2007 | Bishop et al. | |
| 7,341,110 | B2 | 3/2008 | Doane et al. | |
| 7,341,111 | B2 | 3/2008 | Van et al. | |
| 7,350,588 | B2 | 4/2008 | Abercrombie Simpson et al. | 166/382 |
| 7,367,390 | B2 | 5/2008 | Carmody et al. | |
| 7,377,322 | B2 | 5/2008 | Hofman | |
| 7,387,169 | B2 | 6/2008 | Harrell et al. | 166/380 |
| 7,392,849 | B2 | 7/2008 | Lauderdale et al. | |
| 7,424,910 | B2 | 9/2008 | Xu et al. | |
| 7,441,606 | B2 | 10/2008 | Maguire | 166/382 |
| 7,469,750 | B2 | 12/2008 | Carr | |
| 7,481,461 | B2 | 1/2009 | McGarian et al. | 285/145.1 |
| 7,493,945 | B2 | 2/2009 | Doane et al. | |
| 7,493,946 | B2 | 2/2009 | Filippov et al. | |
| 7,497,255 | B2 | 3/2009 | Filippov et al. | |
| 7,516,791 | B2 | 4/2009 | Bryant et al. | |
| 7,543,639 | B2 | 6/2009 | Emerson | |
| 7,546,881 | B2 | 6/2009 | Lloyd et al. | |
| 7,552,766 | B2 | 6/2009 | Gazewood | |
| 7,562,714 | B2 | 7/2009 | Lynde | |
| 7,607,476 | B2 | 10/2009 | Tom et al. | |
| 7,617,868 | B2 | 11/2009 | Stuart et al. | |
| 7,640,976 | B2 | 1/2010 | Filippov | |
| 7,730,941 | B2 | 6/2010 | Abarca et al. | |
| 7,779,910 | B2 | 8/2010 | Watson | |
| 7,784,797 | B2 | 8/2010 | Baugh et al. | |
| 2003/0209352 | A1 | 11/2003 | Davis et al. | |
| 2004/0231838 | A1 | 11/2004 | Carmody et al. | 166/207 |
| 2006/0032628 | A1 | 2/2006 | McGarian et al. | 166/191 |
| 2007/0221374 | A1 | 9/2007 | Filippov et al. | |
| 2007/0272405 | A1 | 11/2007 | Gazewood | |
| 2008/0110643 | A1 | 5/2008 | Richard et al. | |
| 2008/0236844 | A1 | 10/2008 | Gaudette et al. | |
| 2008/0257560 | A1 | 10/2008 | Brisco et al. | 166/377 |
| 2009/0032266 | A1 | 2/2009 | Farquhar et al. | |
| 2009/0107686 | A1 | 4/2009 | Watson | 166/381 |
| 2009/0133930 | A1 | 5/2009 | Thorp et al. | |
| 2009/0223717 | A1 | 9/2009 | Eppink | |
| 2009/0229832 | A1 | 9/2009 | King | |
| 2009/0229835 | A1 | 9/2009 | Filippov | |
| 2009/0242213 | A1 | 10/2009 | Braddick | |
| 2010/0089592 | A1 | 4/2010 | Ring et al. | |
| 2010/0155082 | A1 | 6/2010 | Braddick | |
| 2010/0155084 | A1 | 6/2010 | Watson et al. | |
| 2010/0252252 | A1 | 10/2010 | Harris et al. | |
| 2010/0252278 | A1 | 10/2010 | Harris et al. | |

FOREIGN PATENT DOCUMENTS

| | | | |
|---|---|---|---|
| EP | 0928879 | B1 | 7/1999 |
| EP | 1030031 | B1 | 8/2000 |
| EP | 1052369 | A2 | 11/2000 |
| EP | 1600600 | A2 | 11/2005 |
| EP | 1717411 | A1 | 2/2006 |
| EP | 2072750 | A2 | 6/2009 |
| EP | 2103774 | A1 | 9/2009 |
| EP | 2119867 | A2 | 11/2009 |
| EP | 2175101 | A2 | 4/2010 |
| EP | 2202383 | A1 | 6/2010 |
| GB | 2365041 | A | 2/2002 |
| WO | 9857029 | A1 | 12/1998 |
| WO | WO2004104370 | | 12/2004 |

OTHER PUBLICATIONS

*Brown Oil Tools—Production Equipment Catalog*, pp. 812-814.
*Brown Oil Tools—Liner Packers Catalog*, pp. 41-52.

J. Mota et al., *Drilling in with Expandable Liner Hangers*, E&P (Jun. 2006).
P. Fischer et al., *Suppliers Show Progress in Expandables Innovation*, World Oil (Jul. 2006).
P. Hazel, *Field Deployment of an Expandable Liner Hanger for 7¾" Casing Directional Drilling on a North Sea Well*, Bergen SPE One-Day Conference (Apr. 18, 2007).
*TORXS New Generation Expandable Liner Hanger System*, Baker Hughes Incorporated (Apr. 2009).
*VersaFlex® Liner Hanger System*, www.halliburton.com/ . . . (Apr. 8, 2008).

* cited by examiner

HYDRAULIC SETTING ASSEMBLY

CLAIM TO PRIORITY

This nonprovisional application is a continuation-in-part of prior nonprovisional application of Michael J. Harris and Martin Alfred Stulberg, entitled "Anchor Assembly," U.S. Ser. No. 12/592,026, filed Nov. 19, 2009, and claims priority of provisional application of Michael J. Harris and Marty Stulberg, entitled "Anchoring Device," U.S. Ser. No. 61/166,169, filed Apr. 2, 2009.

FIELD OF THE INVENTION

The present invention relates to downhole tools used in oil and gas well drilling operations and, more particularly, to a hydraulic setting assembly which may be used to actuate anchors for well liners and other downhole tools and to tools and methods utilizing the novel hydraulic setting assembly.

BACKGROUND OF THE INVENTION

Hydrocarbons, such as oil and gas, may be recovered from various types of subsurface geological formations. The formations typically consist of a porous layer, such as limestone and sands, overlaid by a nonporous layer. Hydrocarbons cannot rise through the nonporous layer, and thus, the porous layer forms a reservoir in which hydrocarbons are able to collect. A well is drilled through the earth until the hydrocarbon bearing formation is reached. Hydrocarbons then are able to flow from the porous formation into the well.

In what is perhaps the most basic form of rotary drilling methods, a drill bit is attached to a series of pipe sections referred to as a drill string. The drill string is suspended from a derrick and rotated by a motor in the derrick. As the drilling progresses downward, the drill string is extended by adding more pipe sections.

A drilling fluid or "mud" is pumped down the drill string, through the bit, and into the well bore. This fluid serves to lubricate the bit and carry cuttings from the drilling process back to the surface. As a well bore is drilled deeper and passes through hydrocarbon producing formations, however, the production of hydrocarbons must be controlled until the well is completed and the necessary production equipment has been installed. The drilling fluid also is used to provide that control. That is, the hydrostatic pressure of drilling fluid in the well bore relative to the hydrostatic pressure of hydrocarbons in the formation is adjusted by varying the density of the drilling fluid, thereby controlling the flow of hydrocarbons from the formation.

When the drill bit has reached the desired depth, larger diameter pipes, or casings, are placed in the well and cemented in place to prevent the sides of the borehole from caving in. The casing then is perforated at the level of the oil bearing formation so oil can enter the cased well. If necessary, various completion processes are performed to enhance the ultimate flow of oil from the formation. The drill string is withdrawn and replaced with a production string. Valves and other production equipment are installed in the well so that the hydrocarbons may flow in a controlled manner from the formation, into the cased well bore, and through the production string up to the surface for storage or transport.

This simplified drilling process, however, is rarely possible in the real world. For various reasons, a modern oil well will have not only a casing extending from the surface, but also one or more pipes, i.e., casings, of smaller diameter running through all or a part of the casing. When those "casings" do not extend all the way to the surface, but instead are mounted in another casing, they are referred to as "liners." Regardless of the terminology, however, in essence the modern oil well typically includes a number of tubes wholly or partially within other tubes.

Such "telescoping" tubulars, for example, may be necessary to protect groundwater from exposure to drilling mud. A liner can be used to effectively seal the aquifer from the borehole as drilling progresses. Also, as a well is drilled deeper, especially if it is passing through previously depleted reservoirs or formations of differing porosities and pressures, it becomes progressively harder to control production throughout the entire depth of the borehole. A drilling fluid that would balance the hydrostatic pressure in a formation at one depth might be too heavy or light for a formation at another depth. Thus, it may be necessary to drill the well in stages, lining one section before drilling and lining the next section. Portions of existing casing also may fail and may need to be patched by installing liners within damaged sections of the casing.

The traditional approach to installing a liner in an existing casing has been to connect or "tie" the liner into an anchor, that is, a "liner hanger." Conventional anchors have included various forms of mechanical slip mechanisms that are connected to the liner. The slips themselves typically are in the form of cones or wedges having teeth or roughened surfaces. The typical hanger will include a relatively large number of slips, as many as six or more. A running and/or setting tool is used to position the anchor in place and drive the slips from their initial, unset position, into a set position where they are able to bite into and engage the existing casing. The setting mechanisms typically are either hydraulic, which are actuated by increasing the hydraulic pressure within the tool, or mechanical, which are actuated by rotating, lifting, or lowering the tool, or some combination thereof.

Such mechanical slip hangers may be designed to adequately support the weight of long liners. In practice, however, the wedges, cones, and the like that are intended to grip the existing casing may partially extend as the tool is run through existing casing and can cause the hanger to get stuck. They also may break off and interfere with other tools already in the well or make it difficult to run other tools through the casing at a later time. Moreover, separate "packers" must be used with such anchors if a seal is required between the liner and the existing casing.

One approach to avoiding such problems has been to eliminate in a sense the anchor entirely. That is, instead of tying a liner into an anchor, a portion of the liner itself is expanded into contact with an existing casing, making the liner essentially self-supporting and self-sealing. Thus, the liner conduit is made of sufficiently ductile metal to allow radial expansion of the liner, or more commonly, a portion of the liner into contact with existing casing. Various mechanisms, both hydraulic and mechanical, are used to expand the liner. Such approaches, however, all rely on direct engagement of, and sealing between the expanded liner and the existing casing.

For example, U.S. Pat. No. 6,763,893 to B. Braddick discloses a patch liner assembly that is used, for example, to repair existing casing. The patch assembly comprises a pair of expandable conduits, that is, an upper expandable liner and a lower expandable liner. The expandable liners are connected to the ends of a length of "patch" conduit. The patch assembly is set within the casing by actuating sets of expanding members that radially expand a portion of each expandable liner into engagement with the casing. Once expanded, the expanded portion of the liners provide upper and lower seals that isolate the patched portion of the existing casing. The expanded liners, together with the patch conduit, thereafter provide a passageway for fluids or for inserting other tubulars or tools through the well.

U.S. Pat. No. 6,814,143 to B. Braddick and U.S. Pat. No. 7,278,492 to B. Braddick disclose patch liner assemblies which, similar to Braddick '893, utilize a pair of expandable liners connected via a length of patch conduit. The upper and lower liners are expanded radially outward via a tubular expander into sealing engagement with existing casing. Unlike the expanding members in Braddick '893, however, the tubular expanders disclosed in Braddick '143 and '492 are not withdrawn after the liner portions have been expanded. They remain in the expanded, set liner such that they provide radial support for the expanded portions of the liner.

U.S. Pat. No. 7,225,880 to B. Braddick discloses an approach similar to Braddick '143 and '492, except that it is applied in the context of extension liners, that is, a smaller diameter liner extending downward from an existing, larger diameter casing. An expandable liner is expanded radially outward into sealing engagement with the existing casing via a tubular expander. The tubular expander is designed to remain in the liner and provide radial support for the expanded liner.

U.S. Pat. No. 7,387,169 to S. Harrell et al. also discloses various methods of hanging liners and tying in production tubes by expanding a portion of the tubular via, e.g., a rotating expander tool. All such methods rely on creating direct contact and seals between the expanded portion of the tubular and the existing casing.

Such approaches have an advantage over traditional mechanical hangers. The external surface of the liner has no projecting parts and generally may be run through existing conduit more reliably than mechanical liner hangers. Moreover, the expanded liner portion not only provides an anchor for the rest of the liner, but it also creates a seal between the liner and the existing casing, thus reducing the need for a separate packer. Nevertheless, they suffer from significant drawbacks.

First, because part of it must be expandable, the liner necessarily is fabricated from relatively ductile metals. Such metals typically have lower yield strengths, thus limiting the amount of weight and, thereby, the length of liner that may be supported in the existing casing. Shorter liner lengths, in deeper wells, may require the installation of more liner sections, and thus, significantly greater installation costs. This problem is only exacerbated by the fact that expansion creates a weakened area between the expanded portion and the unexpanded portion of the liner. This weakened area is a potential failure area which can damage the integrity of the liner.

Second, it generally is necessary to expand the liner over a relatively long portion in order to generate the necessary grip on the existing casing. Because it must be fabricated from relatively ductile metal, once expanded, the liner portion tends to relax to a greater degree than if the liner were made of harder metal. This may be acceptable when the load to be supported is relatively small, such as a short patch section. It can be a significant limiting factor, however, when the expanded liner portion is intended to support long, heavy liners.

Thus, some approaches, such as those exemplified by Braddick '143 and '492, utilize expanders that are left in the liner to provide radial support for the expanded portion of the liner. Such designs do offer some benefits, but the length of liner which must be expander still can be substantial, especially as the weight of the liner string is increased. As the length of the area to be expanded increases the forces required to complete the expansion generally increase as well. Thus, there is progressively more friction between the expanding tool and the liner being expanded and more setting force is required to overcome that increasing friction. The need for greater setting forces over longer travel paths also can increase the chances that liner will not be completely set.

Moreover, the liner necessarily must have an external diameter smaller than the internal diameter of the casing into which it will be inserted. This clearance, especially for deep wells where a number of progressively smaller liners will be hung, preferably is as small as possible so as to allow the greatest internal diameter for the liner. Nevertheless, if the tool is to be passed reliably through existing casing, this clearance is still relatively large, and therefore, the liner portion is expanded to a significant degree.

Thus, it may not be possible to fabricate the liner from more corrosion resistant alloys. Such alloys typically are harder and less ductile. In general, they may not be expanded, or expanded only with much higher force, to a degree sufficient to close the gap and grip the existing casing.

Another reality facing the oil and gas industry is that most of the known shallow reservoirs have been drilled and are rapidly being depleted. Thus, it has become necessary to drill deeper and deeper wells to access new reserves. Many operations, such as mounting a liner, can be practiced with some degree of error at relatively shallow depths. Similarly, the cost of equipment failure is relatively cheap when the equipment is only a few thousand feet from the surface.

When the well is designed to be 40,000 feet or even deeper, such failures can be costly in both time and expense. Apart from capital expenses for equipment, operating costs for modern offshore rigs can be $500,000 or more a day. There is a certain irony too in the fact that failures are not only more costly at depth, but that avoiding such failures is also more difficult. Temperature and pressure conditions at great depths can be extreme, thus compounding the problem of designing and building tools that can be installed and will function reliably and predictably.

In particular, hydraulic actuators are commonly employed in downhole tools to generate force and movement, especially linear movement within the tool as may be required to operate the tool. They typically include a mandrel which is connected to a work string. A stationary piston is connected to the mandrel, and a hydraulic cylinder is mounted on, and can slide over the mandrel and the stationary piston. The stationary piston divides the interior of the cylinder into two hydraulic chambers, a top chamber and a bottom chamber. An inlet port allows fluid to flow through the mandrel into the bottom hydraulic chamber, which in turn urges the cylinder downward and away from the stationary piston. As the cylinder moves downward, fluid is able to flow out of the top hydraulic chamber via an outlet port. The movement of the cylinder then may be used to actuate other tool components.

Hydraulic actuators, therefore, can provide an effective mechanism for creating relative movement within a tool, and they are easily actuated from the surface simply by increasing the hydraulic pressure within the tool. Such actuators, however, can be damaged by the hostile environment in which they must operate. The hydrostatic pressures encountered in a well bore can be extreme and imbalances between the pressure in the mandrel and outside the actuator are commonly encountered. If the ports are closed while the tool is being run into a well, such pressure differentials will not cause unintended movement of the actuator, but they can impair subsequent operation of the actuator by deforming the actuator cylinder. Such problems can be avoided by immobilizing the cylinder through other means and simply leaving the ports open to avoid any imbalance of hydrostatic pressure that might deform the actuator cylinder. Fluids in a well bore, however, typically carry a large amount of gritty, gummy debris. The ports and hydraulic chambers in the actuator, therefore, typically are filled with heavy grease before they are run into the well. Nevertheless, the tool may be exposed to wellbore fluid for prolonged periods and under high pressure, and debris still can work its way into conventional actuators and impair their operation.

The increasing depth of oil wells also means that the load capacity of a connection between an existing casing and a liner, whether achieved through mechanical liner hangers or expanded liners, is increasingly important. Higher load capacities may mean that the same depth may be reached with fewer liners. Because operational costs of running a drilling rig can be so high, significant cost savings may be achieved if the time spent running in an extra liner can be avoided.

Ever increasing operational costs of drilling rigs also has made it increasingly important to combine operations so as to reduce the number of trips into and out of a well. For example, especially for deep wells, significant savings may be achieved by drilling and lining a new section of the well at the same time. Thus, tools for setting liners have been devised which will transmit torque from a work string to a liner. A drill bit is attached to the end of the liner, and the liner is rotated.

Torque is typically transmitted through the tool by a serious of tubular sections threaded together via threaded connectors. The rotational forces transmitted through the tool, however, can, be substantial and can damage threaded connections by over-tightening the threads. In addition, it often is useful to rotate opposite to the threads. Such reverse, or "left-handed" rotation may be useful in the actuation and operation of various mechanisms, but it can loosen the connection. In either event, if connections in the torque transmitting components are impaired, it may be difficult or impossible to operate the tool. Set screws, pins, keys, and the like, therefore, have been used to secure a connector, but such approaches are susceptible to failure.

Such disadvantages and others inherent in the prior art are addressed by the subject invention, which now will be described in the following detailed description and the appended drawings.

SUMMARY OF THE INVENTION

The subject invention provides for novel hydraulic actuators and hydraulic setting assemblies which may be used in downhole, oil and gas well tools. The novel hydraulic actuators include a cylindrical mandrel and an annular stationary sealing member connected to the mandrel. A hydraulic cylinder is slidably supported on the mandrel and stationary sealing member and is releasably fixed in position on the mandrel. The stationary sealing member divides the interior of the cylinder into a bottom hydraulic chamber and a top hydraulic chamber. An inlet port provides fluid communication into the bottom hydraulic chamber, and an outlet port provides fluid communication into the top hydraulic chamber.

The novel actuators further include a balance piston. The balance piston is slidably supported within the top hydraulic chamber of the actuator, preferably on the mandrel. The balance piston includes a passageway extending axially through the balance piston. Fluid communication through the piston and between its upper and lower sides is controlled by a normally shut valve in the passageway. Thus, in the absence of relative movement between the mandrel and the cylinder, the balance piston is able to slide in response to a difference in hydrostatic pressure between the outlet port, which is on one side of the balance piston, and the portion of the top hydraulic chamber that is on the bottom side of the balance piston. The novel actuators, therefore, are less susceptible to damage caused by differences in the hydrostatic pressure inside and outside of the actuator. Moreover, the balance piston of the novel actuators is able to prevent the ingress of debris into the actuator.

The normally shut valve in the novel actuators preferably is a rupturable diaphragm. Other preferred embodiments include a pressure release device allowing controlled release of pressure from the top hydraulic cylinder.

In other aspects, the subject invention provides for anchor assemblies that are intended for installation within an existing conduit. The novel anchor assemblies comprise a nondeformable mandrel, an expandable metal sleeve, and a swage. The expandable metal sleeve is carried on the outer surface of the mandrel. The swage is supported for axial movement across the mandrel outer surface from a first position axially proximate to the sleeve to a second position under the sleeve. The movement of the swage from the first position to the second position expands the sleeve radially outward into contact with the existing conduit.

Preferably, the swage of the novel anchor assemblies has an inner diameter substantially equal to the outer diameter of the mandrel and an outer diameter greater than the inner diameter of the expandable metal sleeve. The mandrel of the novel anchor assemblies preferably is fabricated from high yield metal alloys and, most preferably, from corrosion resistant high yield metal alloys.

The novel anchor assemblies preferably have a load capacity of at least 100,000 lbs, more preferably, a load capacity of at least 250,000 lbs, and most preferably a load capacity of at least 500,000 lbs. The novel anchors thus are able to support the weight of liners and other relative heavy downhole tools and well components.

The novel anchor assemblies are intended to be used in combination with a tool for installing the anchor in a tubular conduit. The anchor and tool assembly comprises the anchor assembly, a running assembly, and a setting assembly. The running assembly releasably engages the anchor assembly. The setting assembly is connected to the running assembly and engages the swage and moves it from its first position to its second position.

As will become more apparent from the detailed description that follows, once the sleeve is expanded, the mandrel and swage provide radial support for the sleeve, thereby enhancing the load capacity of the novel anchors. Conversely, by enhancing the radial support for the sleeve, the novel anchors may achieve, as compared to expandable liners, equivalent load capacities with a shorter sleeve, thus reducing the amount of force required to set the novel anchors. Moreover, unlike expandable liners, the mandrel of the novel anchor assemblies is substantially nondeformable and may be made from harder, stronger, more corrosion resistant metals.

In yet other aspects the subject invention provides for novel clutch mechanisms which may be and preferably are used in the mandrel of the novel anchor and tool assemblies and in other sectioned conduits and shafts used to transmit torque. They comprise shaft sections having threads, on the ends to be joined and prismatic outer surfaces adjacent to their threaded ends. A threaded connector joins the threaded ends of the shaft sections. The connector has axial splines. A pair of clutch collars is slidably supported on the prismatic outer surfaces of the shaft sections. The clutch collars have prismatic inner surfaces that engage the prismatic outer surfaces of the shaft sections and axial splines that engage the axial splines on the threaded connector. Preferably, the novel clutch mechanisms also comprise recesses adjacent to the mating prismatic surfaces that allow limited rotation of the clutch collars on the prismatic shaft sections to facilitate engagement and disengagement of the mating prismatic surfaces. Thus, as will become more apparent from the detailed description that follows, the novel clutch mechanisms provide reliable transmission of large amounts of torque through sectioned conduits and other drive shafts without damaging the threaded connections.

Those and other aspects of the invention, and the advantages derived therefrom, are described in further detail below.

Those skilled in the art will appreciate that line breaks along the vertical length of the tool may eliminate well known structural components or inter connecting members, and accordingly the actual length of structural components is not represented.

DESCRIPTION OF ILLUSTRATIVE EMBODIMENTS

The anchor assemblies of the subject invention are intended for installation within an existing conduit. They comprise a nondeformable mandrel, an expandable metal sleeve, and a swage. The expandable metal sleeve is carried on the outer surface of the mandrel. The swage is supported for axial movement across the mandrel outer surface from a first position axially proximate to the sleeve to a second position under the sleeve. The movement of the swage from the first position to the second position expands the sleeve radially outward into contact with the existing conduit.

The novel anchor assemblies are intended to be used in combination with a tool for installing the anchor in a tubular conduit. The anchor and tool assembly comprises the anchor assembly, a running assembly, and a setting assembly. The running assembly releasably engages the anchor assembly. The setting assembly is connected to the running assembly and engages the swage and moves it from its first position to its second position.

The anchor and tool assembly is used, for example, in drilling oil and gas wells and to install liners and other well components. It is connected to a work string which can be raised, lowered, and rotated as desired from the surface of the well. A liner or other well component is attached to the anchor assembly mandrel. The assembly then is lowered into the well through an existing conduit to position the anchor assembly at the desired depth. Once the anchor assembly is in position, the swage is moved axially over the mandrel outer surface by a setting assembly. More particularly, the swage is moved from a position proximate to the expandable metal sleeve to a position under the sleeve, thereby expanding the sleeve radially outward into contact with the existing conduit. Once the metal sleeve has been expanded, the tool is manipulated to release the running assembly from the anchor assembly, and the running and setting assemblies are retrieved from the conduit to complete installation of the liner or other well component.

Figure 1A:
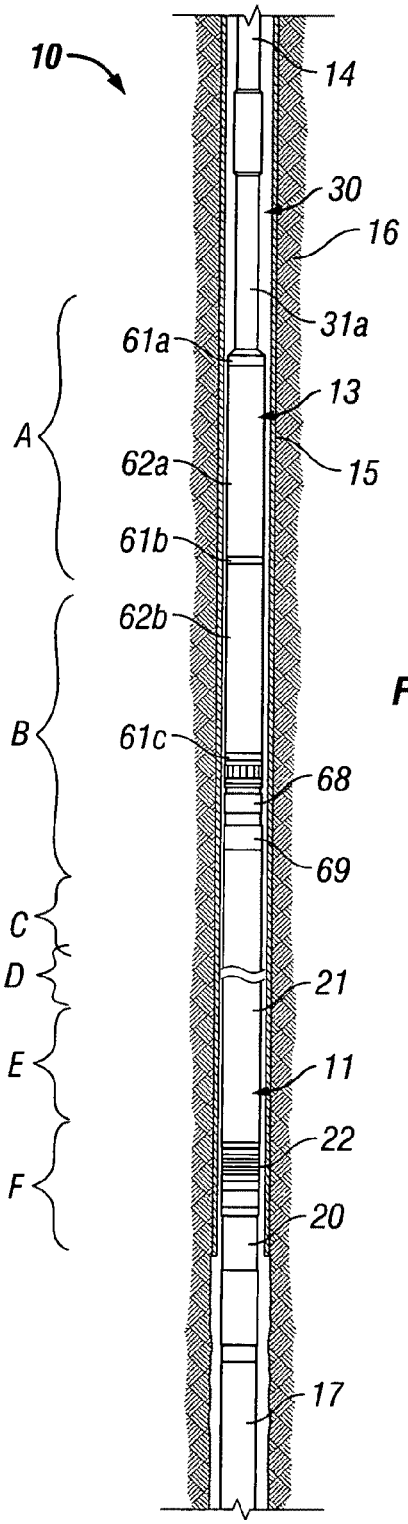
FIG. 1A is a perspective view of a preferred embodiment 10 of the tool and anchor assemblies of the subject invention showing liner hanger tool 10 and liner hanger 11 at depth in an existing casing 15 (shown in cross-section)

For example, FIG. 1A shows a preferred liner hanger tool 10 of the subject invention. Tool 10 includes a preferred embodiment 11 of the novel liner hangers which is connected to a running tool 12 (not shown) and a setting tool 13. Tool 10 is connected at its upper end to a work string 14 assembled from multiple lengths of tubular sections threaded together through connectors. Work string 14 may be raised, lowered, and rotated as needed to transport tool 10 through an existing casing 15 cemented in a borehole through earth 16. Work string 14 also is used to pump fluid into tool 10 and to manipulate it as required for setting hanger 11.

Hanger Assembly

Hanger 11 includes a hanger mandrel 20, a swage 21, and a metal sleeve 22. A 26 liner 17 is attached to the lower end of tool 10, more specifically to hanger mandrel 20 of hanger 11. Liner 17 in turn is assembled from multiple lengths of tubular sections threaded together through connectors. In addition, liner 17 typically will have various other components as may be need to perform various operations in the well, both before and after setting hanger 11. For example, liner 17 typically will be cemented in place. Thus, tool 10 also will include, or the liner 17 will incorporate various well components used to perform such cementing operations, such as a slick joint, cement packoffs, plug landing collars, and the like (not shown). Operation of tool 10, as discussed in detail below, is accomplished in part by increasing hydraulic pressure within tool 10. Thus, when liner 17 is not cemented in place, tool 10 or liner 17 preferably incorporate some mechanism to allow pressure to be built up in work string 14, such as a seat (not shown) onto which a ball may be dropped. Importantly, liner 17 also may include a drill bit (not shown) so that the borehole may be drilled and extended as liner 17 and tool 10 are lowered through existing casing 15.

It will be appreciated, however, that in its broadest embodiments, the anchor and tool assemblies of the subject invention do not comprise any specific liner assemblies or a liner. The anchor assemblies may be used to install a variety of liner assemblies, and in general, may be used to install any other downhole tool or component that requires anchoring within a conduit, such as whipstocks, packers, bridge plugs, cement plugs, frac plugs, slotted pipe, and polished bore receptacles (PBRs). Similarly, while preferred liner hanger tool 10 is exemplified by showing a liner suspended in tension from the anchor assembly, the novel anchor assemblies may also be used to support liners or other well components extending above the anchor assembly, or to secure such components in resistance to torsional forces.

Moreover, as used in industry, a "casing" is generally considered to be a tubular conduit lining a well bore and extending from the surface of the well. Likewise, a "liner" is generally considered to be a tubular conduit that does not extend from the surface of the well, and instead is supported within an existing casing or another liner. In the context of the subject invention, however, it shall be understood that "casing" shall refer to any existing conduit in the well into which the anchor assembly will be installed, whether it extends to the surface or not, and "liner" shall refer to a conduit having an external diameter less than the internal diameter of the casing into which the anchor assembly is installed.

Even more broadly, it will be appreciated that the tool has been exemplified in the context of casings and liners used in drilling oil and gas wells. The invention, however, is not so limited in its application. The novel tool and anchor assemblies may be used advantageously in other conduits where it is necessary to install an anchor by working a tool through an existing conduit to install other tools or smaller conduits.

It also will be appreciated that the figures and description refer to tool 10 as being vertically oriented. Modern wells, however, often are not drilled vertically and, indeed, may extend horizontally through the earth. The novel tool and anchor assemblies also may be used in horizontal wells. Thus, references to up, down, upward, downward, above, below, upper, lower, and the like shall be understood as relative terms in that context.

Figure 1B:
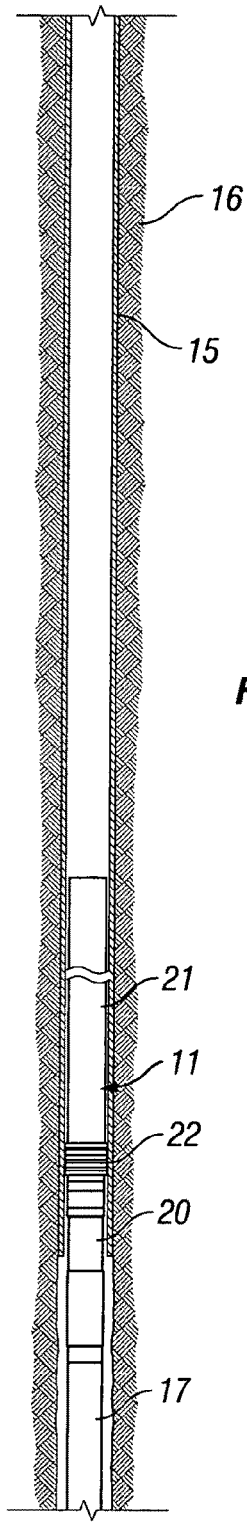
FIG. 1B is a perspective view similar to FIG. 1A showing preferred liner hanger 11 of the subject invention after it has been set in casing 15 by various components of tool 10 and the running and setting assemblies of tool 10 have been retrieved from casing 15.

In FIG. 1A, liner hanger tool 10 is shown in its "run-in" position. That is, it has been lowered into existing casing 15 to the depth at which hanger 11 will be installed. Hanger 11 has not yet been "set" in casing 15, that is, it has not been installed. FIG. 1B shows hanger 11 after it has been installed, that is, after it has been set-in casing 15 and running tool 12 and setting tool 13 have been retrieved from the well. It will be noted in comparing the two figures that hanger mandrel 20 has remained in substantially the same position relative to casing 15, that swage 21 has travelled down tool 10 approximately the length of sleeve 22, and that sleeve 22 has been expanded radially outward into contact with casing 15.

Figure 7A:
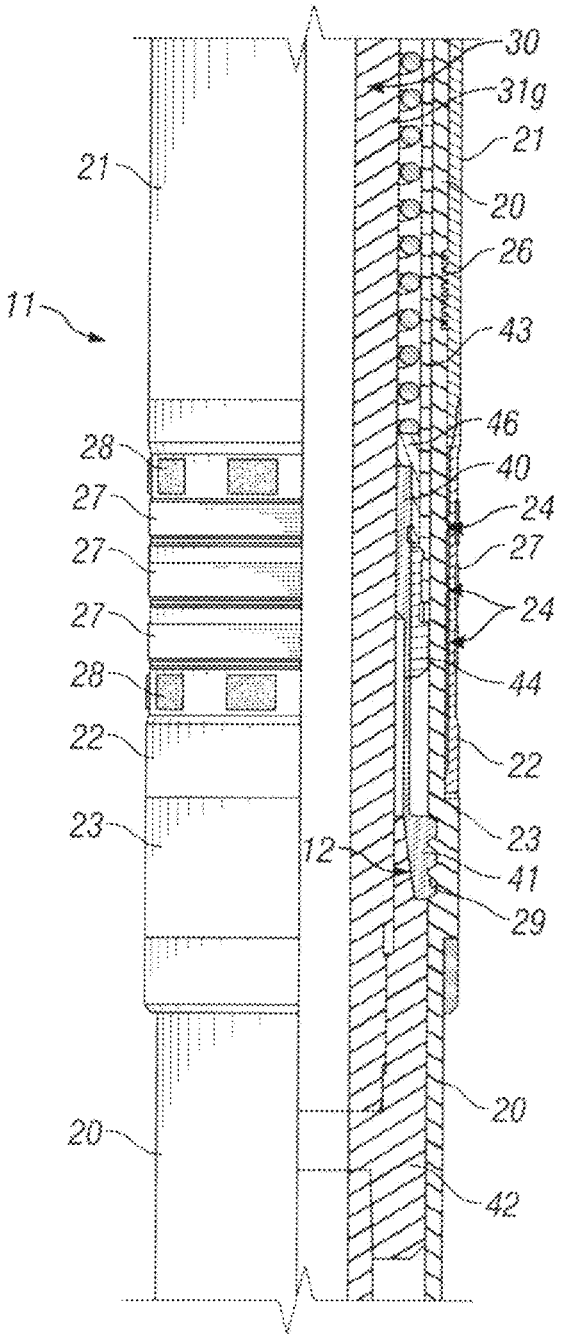
FIG. 7A is an enlarged quarter-sectional view generally corresponding to section F of tool 10 shown in FIG. 1A showing additional details of liner hanger 11 and running tool 12 in their run-in position.
Figure 7B:
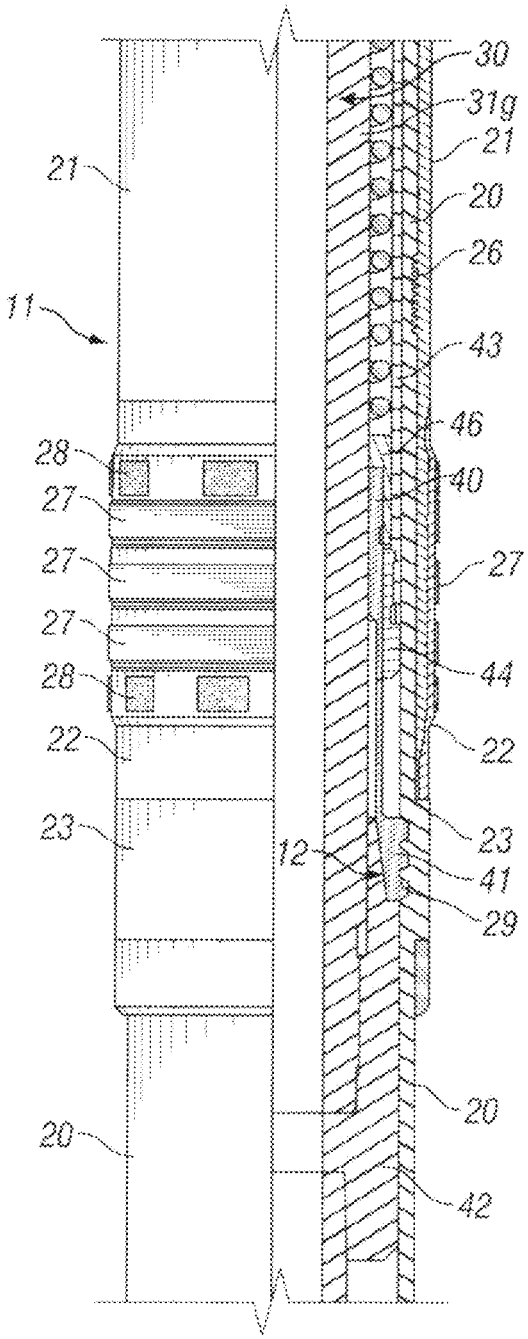
FIG. 7B is a view similar to FIG. 7A showing liner hanger 11 and running tool 12 in their set position.
Figure 7C:
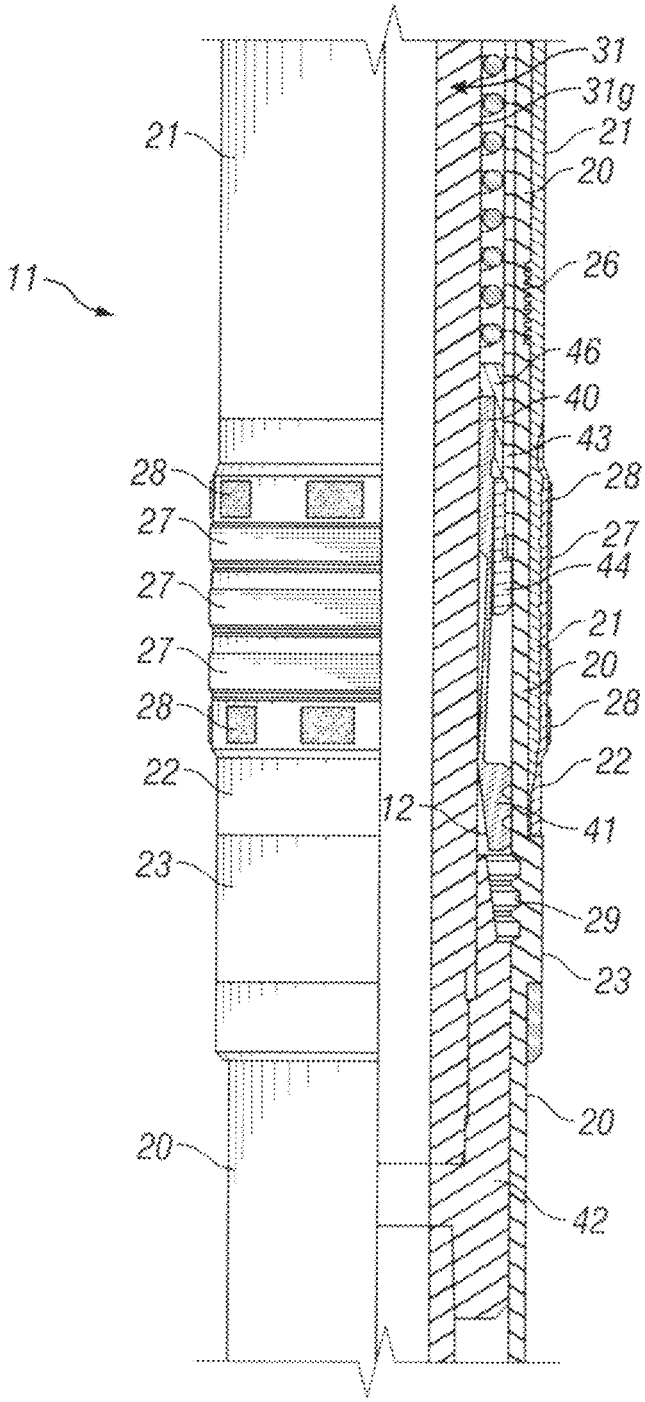
FIG. 7C is a view similar to FIGS. 7*a* and 7B showing liner hanger 11 and running tool 12 in their release position.

Further details regarding liner hanger 11 may be seen in FIG. 7, which show liner hanger 11 and various components of running tool 12. FIG. 7A shows hanger 11 in its "run-in" position, FIG. 7B shows hanger 11 after it has been "set," and FIG. 7C shows hanger tool 11 after it has been "released" from running tool 12.

As may be seen therefrom, hanger mandrel 20 is a generally cylindrical body providing a conduit. It provides a connection at its lower end to, e.g., a liner string (such as liner 17 shown in FIG. 1) through threaded connectors or other conventional connectors. Other liners, such as a patch liner, and other types of well components or tools, such as a whipstock, however, may be connected to mandrel 20, either directly or indirectly. Thus, while described herein as part of liner hanger 11, it also may be viewed as the uppermost component of the liner or other well component that is being installed. As will be described in further detail below, mandrel 20 also is releasably engaged to running tool 12.

As may be seen from FIG. 7A, in the run-in position the upper portion of mandrel 20 provides an outer surface on which are carried both swage 21 and expandable metal sleeve 22. Swage 21 and expandable metal sleeve 22, like mandrel 20, also are generally cylindrical bodies.

Swage 21 is supported for axial movement across the outer surface of mandrel 20. In the run-in position, it is proximate to expandable metal sleeve 22, i.e., it is generally axially removed from sleeve 22 and has not moved into a position to expand sleeve 22 into contact with an existing casing. In theory it may be spaced some, distance therefrom, but preferably, as shown in FIG. 7A, swage 21 abuts metal sleeve 22. Sleeve 22 also is carried on the outer surface of mandrel 20. Preferably, sleeve 22 is restricted from moving upward on mandrel 20 by swage 21 as shown and restricted from moving downward by its engagement with annular shoulder 23 on mandrel 20. It may be restricted, however, by other stops, pins, keys, set screws and the like as are known in the art.

By comparing FIG. 7A and FIG. 7B, it may be seen that hanger 11 is set by actuating swage 21, as will be described in greater detail below, to move across the outer surface of mandrel 20 from its run-in position, where it is proximate to sleeve 22, to its set position, where it is under sleeve 22. This downward movement of swage 21 causes metal sleeve 22 to expand radially into contact with an existing casing (such as casing 15 shown in FIG. 1).

Movement of swage 21 under sleeve 22 preferably is facilitated by tapering the lower end of swage 21 and the upper end of sleeve 22, as seen in FIG. 7A. Preferably, the facing surfaces of mandrel 20, swage 21, and sleeve 22 also are polished smooth and/or are provided with various structures to facilitate movement of swage 21 and to provide seals therebetween. For example, outer surface of mandrel 20 and inner surface of sleeve 22 are provided with annular bosses in the areas denoted by reference numeral 24. Those bosses not only reduce friction between the facing surfaces as swage 21 is being moved, but when swage 21 has moved into place under sleeve 22, though substantially compressed and/or deformed, they also provide metal-to-metal seals between mandrel 20, swage 21, and sleeve 22. It will be understood, however, that annular bosses may instead be provided on the inner and outer surfaces of swage 21, or on one surface of swage 21 in lieu of bosses on either mandrel 20 or sleeve 22. Coatings also may be applied to the facing surfaces to reduce the amount of friction resisting movement of swage 21 or to enhance the formation of seals between facing surfaces.

The outer surface of swage 21, or more precisely, that portion of the outer surface of swage 21 that will move under sleeve 22 preferably is polished smooth to reduce friction therebetween. Likewise, the inner surface of swage 21 preferably is smooth and to polished to reduce friction with mandrel 20. Moreover, once hanger 11 is installed in an existing casing, the upper portion of swage 21 is able to provide a polished bore receptacle into which other well components may be installed.

Preferably, the novel anchor assemblies also include a ratchet mechanism that engages the mandrel and swage and resists reverse movement of the swage, that is, movement of the swage back toward its first position, in which it is axially proximate to the sleeve, and away from its second position, where it is under the sleeve. Liner hanger 11, for example, is provided with a ratchet ring 26 mounted between mandrel 20 and swage 21. Ratchet ring 26 has pawls that normally engage corresponding detents in annular recesses on, respectively, the outer surface of mandrel 20 and the inner surface of swage 21. Ratchet ring 26 is a split ring, allowing it to compress circumferentially, depressing the pawls and allowing them to pass under the detents on swage 21 as swage 21 travels downward in expanding sleeve 22. The pawls on ring 26 are forced into engagement with the detents, however, if there is any upward travel of swage 21. Thus, once set, relative movement between mandrel 20, swage 21, and sleeve 22 is resisted by ratchet ring 26 on the one hand and mandrel shoulder 23 on the other.

It will be appreciated from the foregoing that in the novel anchor assemblies, or at least in the area of travel by the swage, the effective outer diameter of the mandrel and the effective inner diameter of the swage are substantially equal, whereas the effective outer diameter of the swage is greater than the effective inner diameter of sleeve. Thus, for example and as may be seen in FIG. 7B, swage 21 acts to radially expand sleeve 22 and, once sleeve 22 is expanded, mandrel 20 and swage 21 concentrically abut and provide radial support for sleeve 22, thereby enhancing the load capacity of hanger 11. Conversely, by enhancing the radial support for sleeve 22, hanger 11 may achieve equivalent load capacities with a shorter sleeve 22, thus reducing the amount of force required to set hanger 11.

By effective diameter it will be understood that reference is made to the profile of the part as viewed axially along the path of travel by swage 21. In other words, the effective diameter takes into account any protruding structures such as annular bosses which may project from the nominal surface of a part. Similarly, when projections such as annular bosses are provided on mandrel 20 or swage 21, the outer diameter of mandrel 20 will be slightly greater than the inner diameter of swage 21 so that a seal may be created therebetween. "Substantially equal" is intended to encompass such variations, and other normal tolerances in tools of this kind.

Moreover, since hanger mandrel 20 is in a sense the uppermost component of liner 17 to be installed, it will be appreciated that its inner diameter preferably is at least as great as the inner diameter of liner 17 which will be installed. Thus, any further constriction of the conduit being installed in the well will be avoided. More preferably, however, it is substantially equal to the inner diameter of liner 17 so that mandrel 20 may be made as thick as possible.

It also will be appreciated that the mandrel of the novel anchor assemblies is substantially nondeformable, i.e., it resists significant deformation when the swage is moved over its outer surface to expand the metal sleeve. Thus, expansion of the sleeve is facilitated and the mandrel is able to provide significant radial support for the expanded sleeve. It is expected that some compression may be tolerable, on the order of a percent or so, but generally compression is kept to a minimum to maximize the amount of radial support provided. Thus, the mandrel of the novel anchors preferably is fabricated from relatively hard ferrous and non-ferrous metal alloys and, most preferably, from such metal alloys that are corrosion resistant. Suitable ferrous alloys include nickel-chromium-molybdenum steel and other high yield steel. Non-ferrous alloys include nickel, iron, or cobalt superalloys, such as Inconel, Hastelloy, Waspaloy, Rene, and Monel alloys. The superalloys are corrosion resistant, that is, they are more resistant to the chemical, thermal, pressure, and other corrosive conditions commonly encountered in oil and gas wells. Thus, superalloys or other corrosion resistant alloys may be preferable when corrosion of the anchor is a potential problem.

The swage of the novel anchors also is preferably fabricated from such materials. By using such high yield alloys, not only is expansion of the sleeve facilitated, but the mandrel and swage also are able to provide significant radial support for the expanded sleeve and the swage may be made more resistant to corrosion as well.

On the other hand, the sleeve of the novel anchor assemblies preferably is fabricated from ductile metal, such as ductile ferrous and non-ferrous metal alloys. The alloys should be sufficiently ductile to allow expansion of the sleeve without creating cracks therein. Examples of such alloys include ductile aluminum, brass, bronze, stainless steel, and carbon steel. Preferably, the metal has an elongation factor of approximately 3 to 4 times the anticipated expansion of the sleeve. For example, if the sleeve is required to expand on the order of 3%, it will be fabricated from a metal having an elongation factor of from about 9 to about 12%. In general, therefore, the material used to fabricate the sleeve should have an elongation factor of at least 10%, preferably from about 10 to about 20%. At the same time, however, the sleeve should not be fabricated from material that is so ductile that it cannot retain its grip on an existing casing.

It also will be appreciated that the choice of materials for the mandrel, swage, and sleeve should be coordinated to provide minimal deformation of the mandrel, while allowing the swage to expand the sleeve without creating cracks therein. As higher yield materials are used in the mandrel and swage, it is possible to use progressively less ductile materials in the sleeve. Less ductile materials may provide the sleeve with greater gripping ability, but of course will require greater expansion forces.

Significantly, however, by using a ductile, expandable metal seal, and a nondeformable mandrel, it is possible to provide a strong, reliable seal with an existing casing, while avoiding the complexities of other mechanical hangers and the significant disadvantages of expandable liners. More specifically, the novel hangers do not have a weakened area such as exists at the junction of expanded and unexpanded portions of expandable liners. Thus, other factors being equal, the novel hangers are able to achieve higher load ratings.

In addition, expandable liners must be made relatively thick in part to compensate for the weakened area created between the expanded and unexpanded portions. The expandable sleeves of the novel hangers, however, are much thinner. Thus, other factors being equal, the expandable sleeves may be expanded more easily, which in turn reduces the amount of force that must be generated by the setting assembly.

Ductile alloys, from which both conventional expandable liners and the to expandable sleeves of the novel hangers may be made, once expanded, can relax and cause a reduction in the radial force applied to an existing casing. Conventional tools have provided support for expanded liner portions by leaving the swage or other expanding member in the well. The nondeformable mandrel of the novel liner hangers, however, has substantially the same outer diameter as the internal diameter of the swage. Thus, both the mandrel and the swage are able to provide radial support for the expanded sleeve. Other factors being equal, that increased radial support reduces "relaxation" of the expanded, relatively ductile sleeve and, in turn, tends to increase the load capacity of the anchor. At the same time, the mandrel is quite easily provided with an internal diameter at least as great as the liner which will be installed, thus avoiding any further constriction of the conduit provided through the well.

Expandable liner hangers, since they necessarily are fabricated from ductile alloys which in general are less resistant to corrosion, are more susceptible to corrosion and may not be used, or must be used with the expectation of a shorter service life in corrosive environments. The mandrel of the novel hangers, however, may be made of high yield alloys that are much more resistant to corrosion. The expandable sleeve of the novel hangers are fabricated from ductile, less corrosion resistant alloys, but it will be appreciated that as compared to a liner, only a relatively small surface area of the sleeve will be exposed to corrosive fluids. The length of the seal formed by the sleeve also is much greater than the thickness of a liner, expanded or otherwise. Thus, the novel hangers may be expected to have longer service lives in corrosive environments.

The expandable sleeve of the novel anchor assemblies also preferably is provided with various sealing and gripping elements to enhance the seal between the expanded sleeve and an existing casing and to increase the load capacity of the novel hangers. For example, as may be seen in FIG. 7, sleeve 22 is provided with annular seals 27 and radially and axially spaced slips 28 provided on the outer surface thereof. Annular seals may be fabricated from a variety of conventional materials, such as wound or unwound thermally cured elastomers and graphite impregnated fabrics. Slips may be provided by conventional processes, such as by machining slips into the sleeve, or by soldering crushed tungsten-carbide steel or other metal particles to the sleeve surface with a thin coat of high nickel based solder or other conventional solders. When such seals and slips are used the sleeve also preferably is provided with gage protection to minimize contact between such elements and the casing wall as the anchor assembly is run into the well.

As will be appreciated by those skilled in the art, the precise dimensions of the expandable sleeve may be varied so as to, other factors being equal, to provide greater or lesser load capacity and to allow for greater or lesser expansion forces. The external diameter of the sleeve necessarily will be determined primarily by the inner diameter of the liner into which the anchor will be installed and the desired degree of expansion. The thickness of the sleeve will be coordinated with the tensile and ductile properties of the material used in the sleeve so as to provide the desired balance of load capacity and expandability. In general, the longer the sleeve, the greater the load capacity. Thus, the sleeve typically will have a length at least equal to its diameter, and preferably a length of at least 150% of the diameter, so as to provide sufficient surface area to provide load capacities capable of supporting relatively heavy liners and other downhool tools and well components. The novel anchor assemblies thus may be provided with load capacities of at least 100,000 lbs, more preferably, at least 250,000 lbs, and most preferably, at least 500,000 lbs.

Clutch Mechanism

As noted above, the novel anchor assemblies are intended to be used in combination with a tool for installing the anchor in a tubular conduit. For example, running tool 12 is used to releasably engage hanger 11 and setting tool 13 is used to actuate swage 21 and set sleeve 22. There are a variety of mechanisms which may be incorporated into tools to provide such releasable engagement and actuation. In this respect, however, the subject invention does not encompass any specific tool or mechanism for releasably engaging, actuating, or otherwise installing the novel anchor assemblies. Preferably, however, the novel anchors are used with the tools disclosed herein. Those tools are capable of installing the novel anchors easily and reliably. Moreover, as now will be discussed in further detail, they incorporate various novel features and represent other embodiments of the subject invention.

Running tool 12 and setting tool 13, as will be appreciated by comparing FIGS. 2-7, share a common tool mandrel 30. Tool mandrel 30 provides a base structure to which the various components of liner hanger 11, running tool 12, and setting tool 13 are connected, directly or indirectly.

Tool mandrel 30 is connected at its upper end to a work string 14 (see FIG. 1A). Thus, it provides a conduit for the passage of fluids from the work string 14 that are used to balance hydrostatic pressure in the well and to hydraulically actuate setting tool 13 and, ultimately, swage 21. Mandrel 30 also provides for transmission of axial and rotational forces from work string 14 as are necessary to run in the hanger 11 and liner 17, drill a borehole during run-in, set the hanger 11, and release and retrieve the running tool 12 and setting tool 13, all as described in further detail below.

Tool mandrel 30 is a generally cylindrical body. Preferably, as illustrated, it comprises a plurality of tubular sections 31 to facilitate assembly of tool 10 as a whole. Tubular sections 31 may be joined by conventional threaded connectors. Preferably, however, the sections 31 of tool mandrel 30 are connected by novel clutch mechanisms of the subject invention.

The novel clutch mechanisms comprise shaft sections having threads on the ends to be joined. The shaft sections have prismatic outer surfaces adjacent to their threaded ends. A threaded connector joins the threaded ends of the shaft sections. The connector has axial splines. A pair of clutch collars is slidably supported on the prismatic outer surfaces of the shaft sections. The clutch collars have prismatic inner surfaces that engage the prismatic outer surfaces of the shaft sections and axial splines that engage the axial splines on the threaded connector. Preferably, the novel clutch mechanisms also comprise recesses adjacent to the mating prismatic surfaces that allow limited rotation of the clutch collars on the prismatic shaft sections to facilitate engagement and disengagement of the mating prismatic surfaces.

Figure 8A:
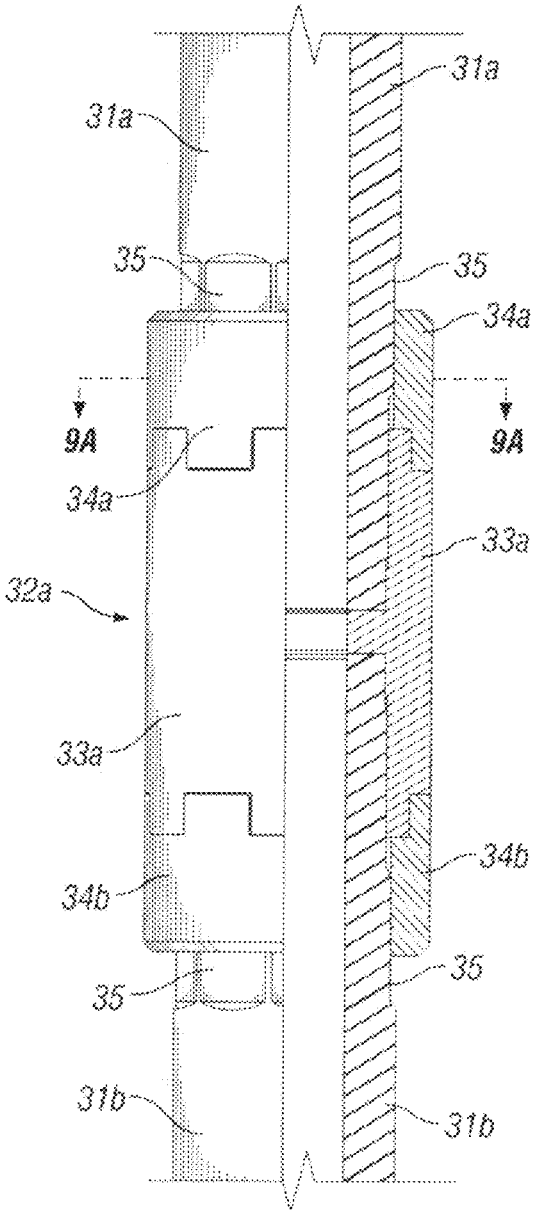
FIG. 8A is a partial, quarter-sectional view of a tool mandrel 30 of tool 10 shown in FIG. 1A (that portion located generally in section A of FIG. 1A) showing details of a preferred embodiment 32 of novel clutch mechanisms of the subject invention.

Accordingly, mandrel 30 of tool 10 includes a preferred embodiment 32 of the novel clutch mechanisms. More particularly, mandrel 30 is made up of a number of tubular sections 31 joined by novel connector assemblies 32. Connector assemblies 32 include threaded connectors 33 and clutch collars 34. FIGS. 8-9 show the portion of mandrel 30 and connector assembly 32*a* which is seen in FIG. 2 and which is representative of the connections used to make up mandrel 30. As may be seen in those figures, lower end of tubular section 31*a* and upper end of tubular section 31*b* are threaded into and joined by threaded connector 33*a*. The threads, as is common in the industry, are right-handed threads, meaning that the connection is tightened by rotating the tubular section to the right, i.e., in a clockwise rotation. The novel clutch mechanisms, however, may be also be used in left-handed connections. Clutch collars 34*a* and 34*b* are slidably supported on tubular sections 31*a* and 31*b*, and when in their coupled or "made-up" position as shown in FIG. 8A, abut connector 33*a*. Connector 33*a* and collars 34*a* and 34*b* have mating splines which provide rotational engagement therebetween.

Figure 9A:
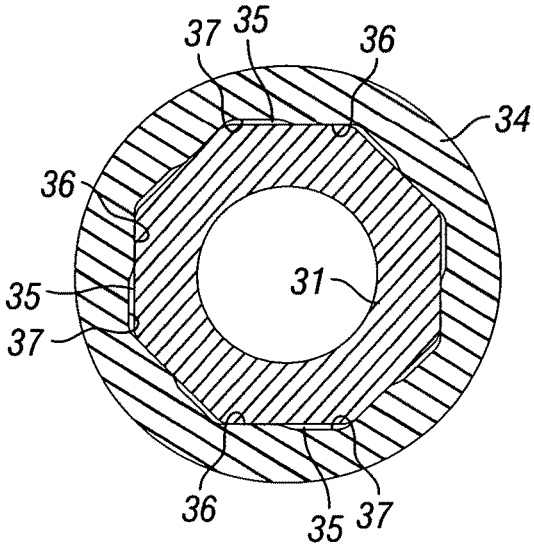
FIG. 9A is a cross-sectional view taken along line 9A-9A of FIG. 8A of connector assembly 32.

Tubular sections 31 have prismatic outer surfaces 35 adjacent to their threaded ends. That is, the normally cylindrical outer surfaces of tubular sections 31 have been cut to provide a plurality of flat surfaces extending axially along the tubular section such that, when viewed in cross section, flat surfaces define or can be extended to define a polygon. For example, as seen best in FIG. 9A, tubular section 31*a* has octagonal prismatic outer surfaces 35. The inner surface of clutch collar 34*a* has mating octagonal prismatic inner surfaces 36. Clutch collar 34*b* is of similar construction. Thus, when in their coupled positions as shown in FIG. 9A, prismatic surfaces 35 and 36 provide rotational engagement between sections 31*a* and 31*b* and collars 34*a* and 34*b*. It will be appreciated, therefore, that torque may be transmitted from one tubular section 31 to another tubular section 31, via collars 34 and connectors 33, without applying torque to the threaded connections between the tubular sections 31.

Figure 8B:
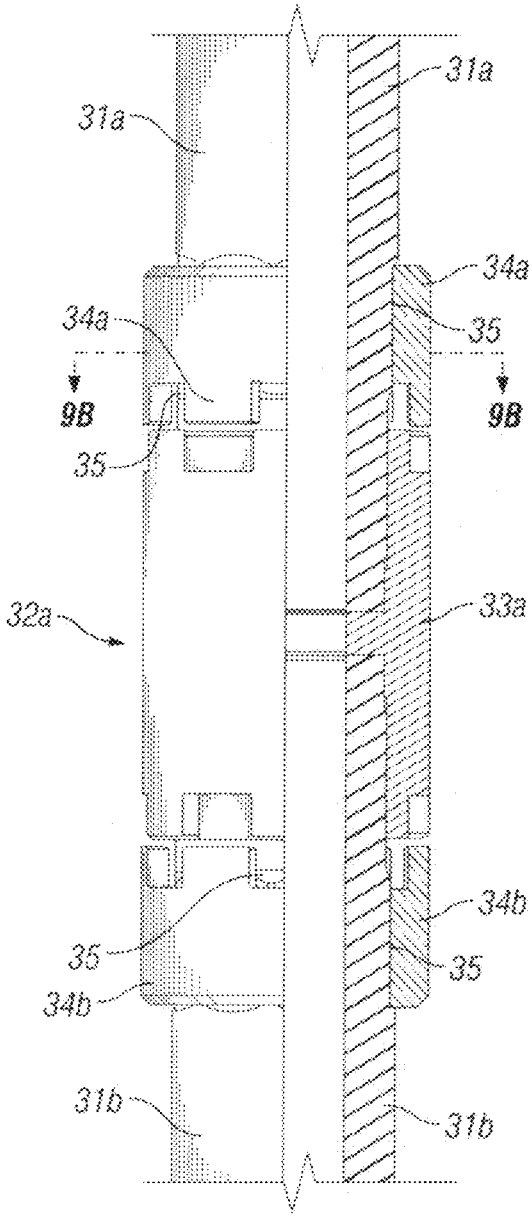
FIG. 8B is a view similar to FIG. 7A showing connector assembly 32 in an uncoupled position.
Figure 9B:
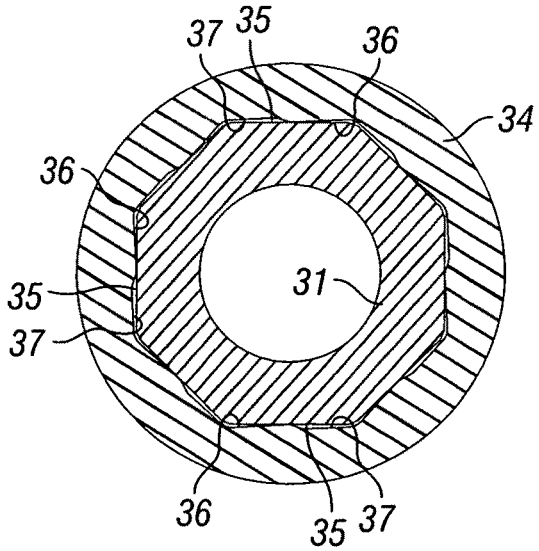
FIG. 9B is a view similar to FIG. 8A taken along line 9B-9B of FIG. 8B showing connector assembly 32 in an uncoupled position.

FIGS. 8B and 9B show connector assembly 32*a* in uncoupled states. It will be noted that prismatic surfaces 35 extend axially on tubular sections 31*a* and 31*b* and allow the splines on collars 34*a* and 34*b* to slide into and out of engagement with the splines on connector 33*a*, as may be appreciated by comparing FIGS. 8A and 8B. Recesses preferably are provided adjacent to the mating prismatic surfaces to facilitate that sliding. For example, as may be seen in FIG. 9, recesses 37 are provided adjacent to prismatic surfaces 36 on collar 34*a*. Those recesses allow collar 34*a* to rotate to a limited degree on tubular sections 31*a*. When rotated to the left, as shown in FIG. 9B, surfaces 35 and 36 are disengaged, and collar 34*a* may slide more freely on tubular section 31*a*. Thus, collars 34 may be more easily engaged and disengaged with connectors 33. Once collars 34 have been moved into engagement with connectors 33, collars 34 and connectors 33 may be rotated together in a clockwise direction to complete make-up of the connection. Preferably, set screws, pins, keys, or the like (not shown) then are installed to secure collars 34 and prevent them from moving axially along tubular sections 31.

It will be appreciated, therefore, that the novel clutch mechanisms provide for reliable and effective transmission of torque in both directions through a sectioned conduit, such as tool mandrel 30. In comparison to conventional set screws and the like, mating prismatic surfaces and splines on the connector and collars provide much greater surface area through which right-handed torque is transmitted. Thus, much greater rotational forces, and forces well in excess of the torque limit of the threaded connection, may be transmitted in a clockwise direction through a sectioned conduit and its connector assemblies without risking damage to threaded connections. The novel clutch mechanisms, therefore, are particularly suited for tools used in drilling in a liner and other applications that subject the tool to high torque. In addition, because the collars cannot rotate in a counterclockwise direction, or if recesses are provided can rotate in a counterclockwise direction only to a limited degree, left-handed torque may be applied to a tool mandrel without risk of significant loosening or of unthreading the connection. Thus, the tool may be designed to utilize reverse rotation, such as may be required for setting or, release of a liner or other well component, without risking disassembly of the tool in a well bore.

At the same time, however, it will be appreciated that mandrel 30 may be made up with conventional connections. Moreover, the novel liner hangers may be used with tools having a conventional mandrel, and thus, the novel clutch mechanisms form no part of that aspect of the subject invention. It also will be appreciated that the novel clutch mechanisms may be used to advantage in making up any tubular strings, in mandrels for other tools, or in other sectioned conduits or shafts, or any other threaded connection where threads must be protected from excessive torque.

Running Assembly

Running tool 12 includes a collet mechanism that releasably engages hanger mandrel 20 and which primarily bears the weight of liner 17 or other well components connected directly or indirectly to hanger mandrel 20. Running tool 12 also includes a releasable torque transfer mechanism for transferring torque to hanger mandrel 20 and a releasable dog mechanism that provides a connection between running tool 12 and tool mandrel 30.

Tubular section 31*g* of mandrel 30 provides a base structure on which the various other components of running tool 12 are assembled. As will be appreciated from the discussion follows, most of those other components are slidably supported; directly or indirectly, on tubular section 31*g*. During assembly of tool 10 and to a certain extent in their run-in position, however, they are fixed axially in place on tubular section 31*g* by the dog mechanism, which can be released to allow release of the collet mechanism engaging hanger mandrel 20.

More particularly, as seen best in FIG. 7, running tool 12 includes a collet 40 which has an annular base slidably supported on mandrel 30. A plurality of fingers extends axially downward from the base of collet 40. The collet fingers have enlarged ends 41 which extend radially outward and, when tool 10 is in its run-in position as shown in FIG. 7A, engage corresponding annular recesses 29 in hanger mandrel 20. A bottom collar 42 is threaded onto the end of tool mandrel 30, and its upper beveled end provides radial and axial support for the ends 41 of collet 40. Thus, collet 40 is able to bear the weight of mandrel 20, liner 17, and any other well components that may be connected directly or indirectly thereto. Although not shown in the figures, it will be appreciated that bottom collar 42 also may provide a connection, e.g., via a threaded lower end, to a slick joint or other well components.

As may be seen best in FIGS. 6-7, collet 40, or more precisely, its annular base is slidably supported on mandrel 30 within an assembly including a sleeve 43, an annular collet cap 46, an annular sleeve cap 44, and annular thrust cap 45. Sleeve 43 is generally disposed within hanger mandrel 20 and slidably engages the inner surface thereof. Sleeve cap 44 is threaded to the lower end of sleeve 43 and is slidably carried between hanger mandrel 20 and collet 40. Thrust cap 45 is threaded to the upper end of sleeve 43 and is slidably carried between swage 21 and tubular section 31*g*. Collet cap 46 is threaded to the upper end of collet 40 and is slidably carried between sleeve 43 and tubular section 31*g*. The collet 40 and cap 46 subassembly is spring loaded within sleeve 43 between sleeve cap 44 and thrust cap 45.

As may be appreciated from FIG. 6, thrust cap 45 abuts at its upper end an annular dog housing 47 and abuts hanger mandrel 20 at its lower end. Hanger mandrel 20 and thrust cap 45 rotationally engage each other via mating splines, similar to those described above in reference to the connector assemblies 32 joining tubular sections 31. In addition, though not shown in any detail, tubular section 31*g* is provided with lugs, radially spaced on its outer surface, which rotationally engage corresponding slots in thrust cap 45. The slots extend laterally and circumferentially away from the lugs to allow, for reasons discussed below, tubular section 31*g* to move axially downward and to rotate counterclockwise a quarter-turn. Otherwise; however, when tool 10 is in its run-in position the engagement between those lugs and slots provide rotational engagement in a clockwise direction between tubular section 31*g* and thrust cap 45, thus ultimately allowing clockwise torque to be transmitted from tool mandrel 30 to hanger mandrel 20. Running tool 12, therefore, may be used to drill in a liner. That is, a drill bit may be attached to the end liner 17 and the well bore extended by rotating work string 14.

Figure 6A:
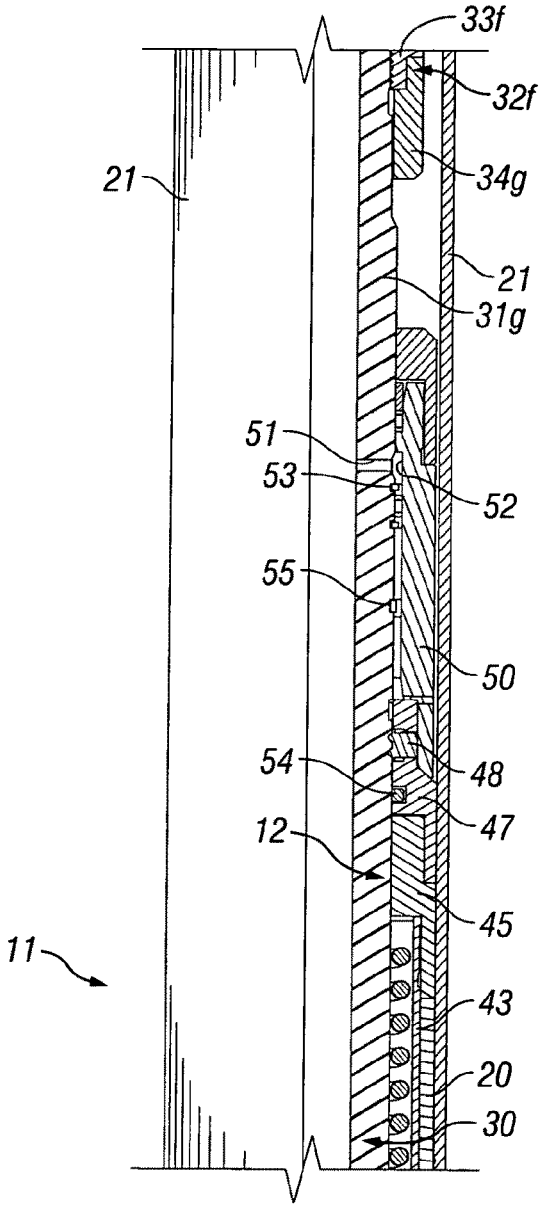
FIG. 6A is an enlarged quarter-sectional view generally corresponding to section E of tool 10 shown in FIG. 1A showing details of a preferred embodiment of the running assemblies of the subject invention showing running tool 12 and liner hanger 11 in their run-in position.

Although not shown in their entirety or in great detail, it will be appreciated that dog housing 47 and tubular section 31*g* of mandrel 30 have cooperating recesses that entrap a plurality of dogs 48 as is common in the art. Those recesses allow dogs 48 to move radially, that is, in and out to a limited degree. It will be appreciated that the inner ends (in this sense, the bottom) of dogs 48 are provided with pawls which engage the recess in tubular section 31*g*. The annular surfaces of those pawls and recesses are coordinated such that downward movement of mandrel 30 relative to dog housing 47, for reasons to be discussed below, urges dogs 48 outward. In the run-in position, as shown in FIG. 6A, however, a locking piston 50, which is slidably supported on tubular section 31*g*, overlies dog housing 47 and the tops of the cavities in which dogs 48 are carried. Thus, outward radial movement of dogs 48 is further limited and dogs 48 are held in an inward position in which they engage both dog housing 47 and tubular section 31*g*.

Thus, dogs 48 are able to provide a translational engagement between mandrel 30 and running tool 12 when tool 10 is in the run-in position. This engagement is not typically loaded with large amounts of force when the tool is in its run-in position, as the weight of tool 10 and liner 17 is transmitted to tool mandrel 30 primarily through collet ends 41 and bottom collar 41 and torque is transmitted from mandrel 30 through thrust cap 45 and hanger mandrel 20. The engagement provided by dogs 48, however, facilitates assembly of tool 10 and will bear any compressive load inadvertently applied between hanger 11 and tool mandrel 30. Thus, dogs 48 will prevent liner hanger 11 and running tool 12 from moving upward on mandrel 30 such as might otherwise occur if tool 10 gets hung up as it is run into an existing casing. Release of dogs 48 from that engagement will be described in further detail below in the context of setting hanger 11 and release of running tool 12.

It will be appreciated that running tool 12 described above provides a reliable, effective mechanism for releasably engaging liner hanger 11, for securing liner hanger from moving axially on mandrel 30, and for transmitting torque from mandrel 30 to hanger mandrel 20. Thus, it is a preferred tool for use with the liner hangers of the subject invention. At the same time, however, other conventional running mechanisms, such as mechanisms utilizing a left-handed threaded nut or dogs only, may be used, particularly if it is not necessary or desirable to provide for the transmission of torque through the running mechanism. The subject invention is in no way limited to a specific running tool.

Setting Assembly

Setting tool 13 includes a hydraulic mechanism for generating translational force, relative to the tool mandrel and the work string to which it is connected, and a mechanism for transmitting that force to swage 21 which, upon actuation, expands metal sleeve 22 and sets hanger 11. It is connected to running tool 12 through their common tool mandrel 30, with tubular sections 31*a-f* of mandrel 30 providing a base structure on which the various other components of setting tool 13 are assembled.

As will be appreciated from FIGS. 2-5, the hydraulic mechanism comprises a number of cooperating hydraulic actuators 60 supported on tool mandrel 30. Those hydraulic actuators are linear hydraulic motors designed to provide linear force to swage 21. Those skilled in the art will appreciate that actuators 60 are interconnected so as to "stack" the power of each actuator 60 and that their number and size may be varied to create the desired linear force for expanding sleeve 22.

As is common in such actuators, they comprise a mandrel. Though actuators for other applications may employ different configurations, the mandrel in the novel actuators, as is typical for oil well tools and components, preferably is a generally cylindrical mandrel. A stationary sealing member, such as a piston, seal, or an extension of the mandrel itself, extends continuously around the exterior of the mandrel. A hydraulic barrel or cylinder is slidably supported on the outer surfaces of the mandrel and the stationary sealing member. The cylinder includes a sleeve or other body member with a pair of dynamic sealing members, such as pistons, seals, or extensions of the body member itself, spaced on either side of the stationary sealing member and slidably supporting the cylinder. The stationary sealing member divides the interior of the cylinder into two hydraulic chambers, a top chamber and a bottom chamber. An inlet port provides fluid communication into the bottom hydraulic chamber. An outlet port provides fluid communication into the top hydraulic chamber. Thus, when fluid is introduced into the bottom chamber, relative linear movement is created between the mandrel and the cylinder. In setting tool 13, this is downward movement of the cylinder relative to mandrel 30.

For example, what may be viewed as the lowermost hydraulic actuator 60*e* is shown in FIG. 4. This lowermost hydraulic actuator 60*e* comprises floating annular pistons 61*e* and 61*f*. Floating pistons 61*e* and 61*f* are slidably supported on tool mandrel 30, or more precisely, on tubular sections 31*e* and 31*f*, respectively. A cylindrical sleeve 62*e* is connected, for example, by threaded connections to floating pistons 61*e* and 61*f* and extends therebetween. An annular stationary piston 63*e* is connected to tubular section 31*f* of tool mandrel 30, for example, by a threaded connection. Preferably, set screws, pins, keys, or the like are provided to secure those threaded connections and to reduce the likelihood they will loosen.

Figure 4A:
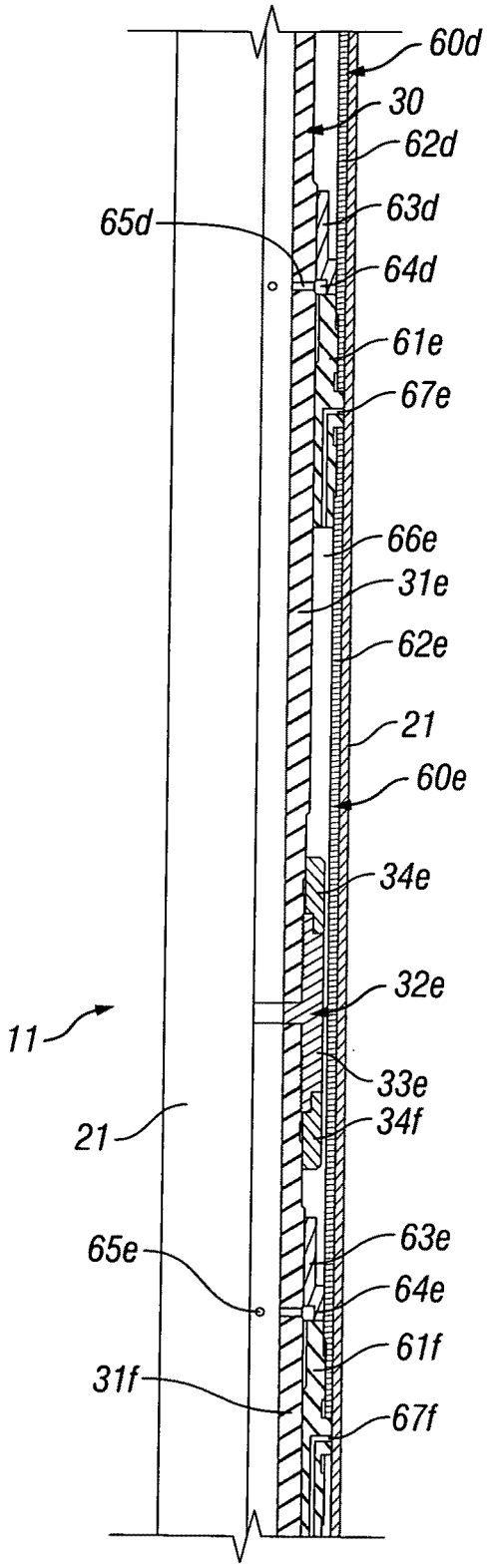
FIG. 4A is an enlarged quarter-sectional view generally corresponding to section C of tool 10 shown in FIG. 1A showing further details of setting tool 13 and portions of liner hanger 11 in their run-in position.
Figure 4B:
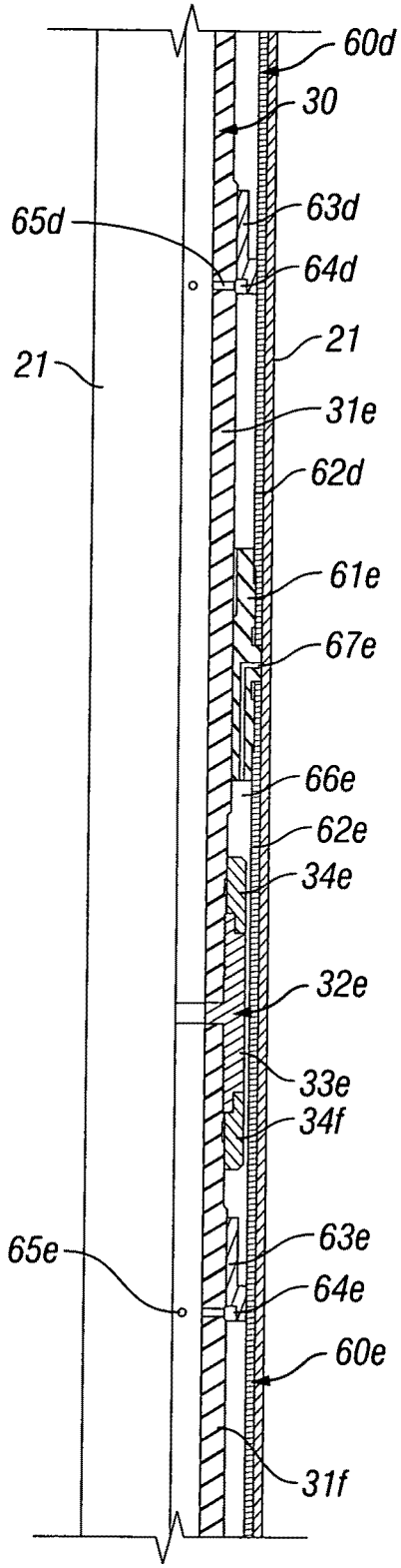
FIG. 4B is a view similar to FIG. 4A showing setting tool 13 and liner hanger 11 in their set position.

In the run-in position shown in FIG. 4A, floating piston 61*f* is in close proximity to stationary piston 63*e*. A bottom hydraulic chamber is defined therebetween, either by spacing the pistons or by providing recesses in one or both of them, and a port is provided is through the mandrel to allow fluid communication with the bottom hydraulic chamber. For example, floating piston 61*f* and stationary piston 63*e* are provided with recesses which define a bottom hydraulic chamber 64*e* therebetween, even if pistons 61*f* and 63*e* abut each other. One or more inlet ports 65*e* are provided in tubular section 31*f* to provide fluid communication between the interior of tool mandrel 30 and bottom hydraulic chamber 64*e*.

Floating piston 61*e*, on the other hand, is distant from stationary piston 63*e*, and a top hydraulic chamber 66*e* is defined therebetween. One or more outlet ports 67*e* are provided in floating piston 61*e* to provide fluid communication between top hydraulic chamber 66*e* and the exterior of cylinder sleeve 62*e*. Alternately, outlet ports could be provided in cylinder sleeve 62*e*, and it will be appreciated that the exterior of cylinder sleeve 62*e* is in fluid communication with the exterior of the tool, i.e., the well bore, via clearances between cylinder sleeve 62*e* and swage 21. Thus, fluid flowing through inlet ports 65*e* into bottom hydraulic chamber 64*e* will urge floating piston 61*f* downward, and in turn cause fluid to flow out of top hydraulic chamber 66*e* through outlet ports 67*e* and allow actuator 60*e* to travel downward along mandrel 30, as may be seen in FIG. 4B.

Setting tool 13 includes another actuator 60*d* of similar construction located above actuator 60*e* just described. Parts of actuator 60*d* are shown in FIGS. 3 and 4.

Setting tool 13 engages swage 21 of liner hanger 11 via another hydraulic actuator 60*c* which is located above hydraulic actuator 60*d*. More particularly, as may be seen in FIG. 3, engagement actuator 60*c* comprises a pair of floating pistons 61*c* and 61*d* connected by a sleeve 62*c*. Floating pistons 61*c* and 61*d* are slidably supported, respectively, on tubular sections 31*c* and 31*d* around stationary piston 63*c*. One or more inlet ports 65*c* are provided in tubular section 31*c* to provide fluid communication between the interior of tool mandrel 30 and bottom hydraulic chamber 64*c*. One or, more outlet ports 67*c* are provided in cylinder sleeve 62*c* to provide fluid communication between top hydraulic chamber 66*c* and the exterior of actuator 60*c*.

It will be noted that the upper portion of sleeve 62*c* extends above swage 21 while its lower portion extends through swage 21, and that upper end of sleeve 62*c* is enlarged relative to its lower portion. An annular adjusting collar 68 is connected to the reduced diameter portion of sleeve 62*c* via, e.g., threaded connections. An annular stop collar 69 is slidably carried on the reduced diameter portion of sleeve 62*c* spaced somewhat below adjusting collar 68 and just above and abutting swage 21. Adjusting collar 68 and stop collar 69 are tied together by shear pins (not shown) or other shearable members. It will be appreciated that in assembling tool 10, rotation of adjusting collar 68 and stop collar 69 allows relative movement between setting tool 13 and running tool 12 on the one hand and liner hanger 11 on the other, ultimately allowing collet ends 41 of running tool 12 to be aligned in annular recesses 29 of hanger mandrel 20.

Setting tool 13 includes what may be viewed as additional drive actuators 60*a* and 60*b* located above engagement actuator 60*c* shown in FIG. 3. As with the other hydraulic actuators 60, and as may be seen in FIG. 2, the uppermost hydraulic actuator 60*a* comprises a pair of floating pistons 61*a* and 61*b* connected by a sleeve 62*a* and slidably supported, respectively, on tubular sections 31*a* and 31*b* around stationary piston 63*a*. One or more inlet ports 65*a* are provided in tubular section 31*a* to provide fluid communication between the interior of tool mandrel 30 and bottom hydraulic chamber 64*a*. One or more outlet ports 67*a* are provided in floating piston 61*a* to provide fluid communication between top hydraulic chamber 66*a* and the exterior of actuator 60*a*. (It will be understood that actuator 60*b*, as shown in part in FIGS. 2 and 3, is constructed in a fashion similar to actuator 60*a*.)

It will be appreciated that hydraulic actuators 60 preferably are immobilized in their run-in position. Otherwise, they may be actuated to a greater or lesser degree by differences in hydrostatic pressure between the interior of mandrel 30 and the exterior of tool 10. Thus, setting tool 13 preferably incorporates shearable members, such as pins, screws, and the like, or other means of releasably fixing actuators 60 to mandrel 30.

The setting tool 13 preferably incorporates the hydraulic actuators of the subject invention. The novel hydraulic actuators include a balance piston. The balance piston is slidably supported within the top hydraulic chamber of the actuator, preferably on the mandrel. The balance piston includes a passageway extending axially through the balance piston. Fluid communication through the piston and between its upper and lower sides is controlled by a normally shut valve in the passageway. Thus, in the absence of relative movement between the mandrel and the cylinder, the balance piston is able to slide in response to a difference in hydrostatic pressure between the outlet port, which is on one side of the balance piston, and the portion of the top hydraulic chamber that is on the bottom side of the balance piston.

Figure 2A:
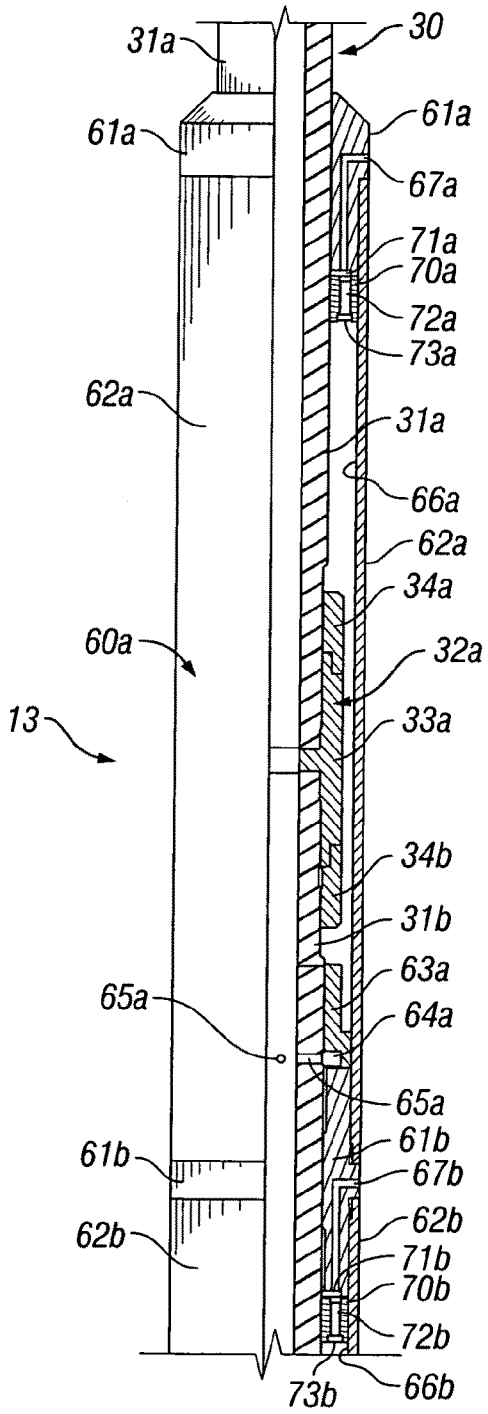
FIG. 2A is an enlarged quarter-sectional view generally corresponding to section A of tool 10 shown in FIG. 1A showing details of a preferred embodiment 13 of the setting assemblies of the subject inventions showing setting tool 13 in its run-in position.
Figure 2B:
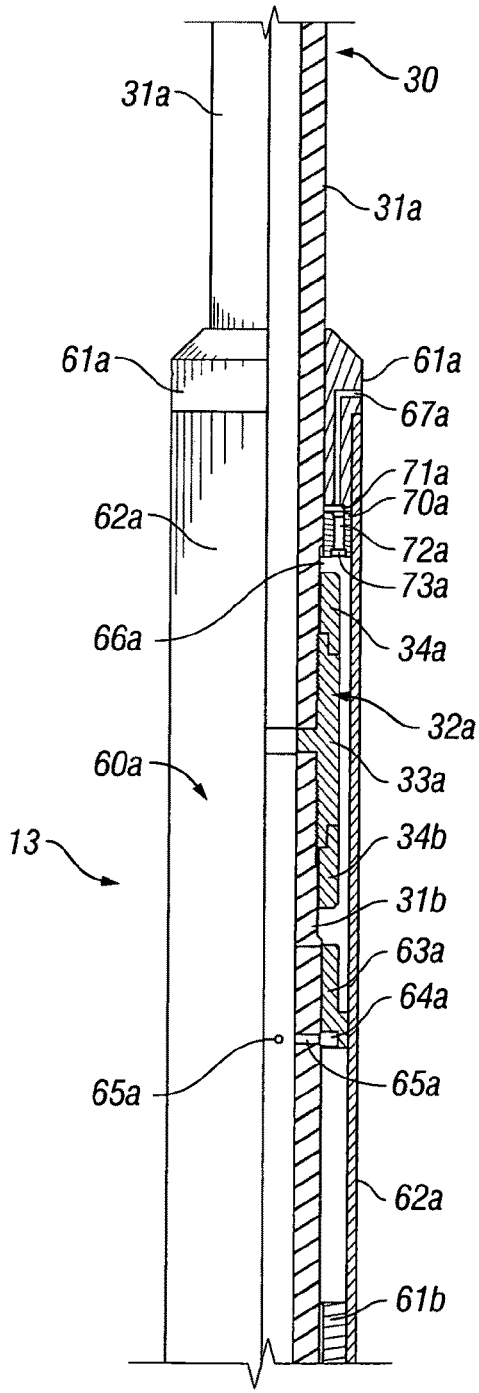
FIG. 2B is a quarter-sectional view similar to FIG. 2A showing setting tool 13 in its set position.

For example, as may be seen in FIG. 2, actuator 60*a* includes balance piston 70*a*. Balance piston 70*a* is slidably supported on tubular section 31*a* of mandrel 30 in top hydraulic chamber 66*a* between floating piston 61*a* and stationary piston 63*a*. When tool 10 is in its run-in position, as shown in FIG. 2A, balance piston 70*a* is located in close proximity to floating piston 61*a*. A hydraulic chamber is defined therebetween, either by spacing the pistons or by providing recesses in one or both of them, and a port is provided through the mandrel to allow fluid communication with the hydraulic chamber. For example, floating piston 61*a* is provided with a recess which defines a hydraulic chamber 71*a* therebetween, even if pistons 61*a* and 70*a* abut each other.

Balance piston 70*a* has a passageway 72*a* extending axially through its body portion, i.e., from its upper side to its lower side. Passageway 72*a* is thus capable of providing fluid communication through balance piston 70*a*, that is, between hydraulic chamber 71*a* and the rest of top hydraulic chamber 66*a*. Fluid communication through passageway 72*a*, however, is controlled by a normally shut valve, such as rupturable diaphragm 73*a*. When diaphragm 73*a* is in its closed, or unruptured state, fluid is unable to flow between hydraulic chamber 71*a* and the rest of top hydraulic chamber 66*a*.

Actuator 60*b* also includes a balance piston 70*b* identical to balance piston 70*a* described above. Thus, when tool 10 is in its run-in position shown in FIG. 2A, balance pistons 70*a* and 70*b* are able to equalize pressure between the top hydraulic chambers 66*a* and 66*b* and the exterior of actuators 60*a* and 60*b* such as might develop, for example, when tool 10 is being run into a well. Fluid is able to enter outlet ports 67*a* and 67*b* and, to the extent that such exterior hydrostatic pressure exceeds the hydrostatic pressure in top hydraulic chambers 66*a* and 66*b*, balance pistons 70*a* and 70*b* will be urged downward until the pressures are balanced. Such balancing of internal and external pressures is important because it avoids deformation of cylinder sleeves 62*a* and 62*b* that could interfere with travel of sleeves 62*a* and 62*b* over stationary pistons 63*a* and 63*b*.

Moreover, by not allowing ingress of significant quantities of fluid from a well bore as tool 10 is being run into a well, balance pistons 70*a* and 70*b* further enhance the reliability of actuators 60*a* and 60*b*. That is, balance pistons 70*a* and 70*b* greatly reduce the amount of debris that can enter top hydraulic chambers 66*a* and 66*b*, and since they are located in close proximity to outlet ports 67*a* and 67*b*, the substantial majority of the travel path is maintained free and clear of debris. Hydraulic chambers 66*a* and 66*b* preferably are filled with clean hydraulic fluid during assembly of tool 10, thus further assuring that when actuated, floating pistons 61*a* and 61*b* and sleeves 62*a* and 62*b* will slide cleanly and smoothly over, respectively, tubular sections 31*a* and 31*b* and stationary pistons 63*a* and 63*b*.

It will be appreciated that for purposes of balancing the hydrostatic pressure between the top hydraulic chamber and a well bore the exact location of the balance piston in the top hydraulic chamber of the novel actuators is not critical. It may be spaced relatively close to a stationary piston and still provide such balancing. In practice, the balance piston will not have to travel a great distance to balance pressures and, therefore, it may be situated initially at almost any location in the top hydraulic chamber between the external opening of the outlet port and the stationary piston.

Preferably, however, the balance piston in the novel actuators is mounted as close to the external opening of the outlet port as practical so as to minimize exposure of the inside of the actuator to debris from a well bore. It may be mounted within a passageway in what might be termed the "port," such as ports 67*a* shown in the illustrated embodiment 60*a*, or within what might otherwise be termed the "chamber," such as top hydraulic chamber 66*a* shown in the illustrated embodiment 60*a*. As understood in the subject invention, therefore, when referencing the location of a balance piston, the top hydraulic chamber may be understood as including all fluid cavities, chambers, passageways and the like between the port exit and the stationary piston. If mounted in a relatively narrow passageway, such as the outlet ports 67*a*, however, the balance piston will have to travel greater distances to balance hydrostatic pressures. Thus, in the illustrated embodiment 60*a* the balance piston 70*a* is mounted on tubular sections 31*a* in the relatively larger top hydraulic chamber 66*a*.

It also will be appreciated that, to provide the most effective protection from debris, the normally shut valves in the balance position should be selected such that they preferably are not opened to any significant degree by the pressure differentials they are expected to encounter prior to actuation of the actuator. At the same time, as will be appreciated from the discussion that follows, they must open, that is, provide release of increasing hydrostatic pressure in the top hydraulic chamber when the actuator is actuated. Most preferably, the normally shut valves remain open once initially opened. Thus, rupturable diaphragms are preferably employed because they provide reliable, predictable release of pressure, yet are simple in construction and can be installed easily. Other normally shut valve devices, such as check valves, pressure relief valves, and plugs with shearable threads, however, may be used in the balance piston on the novel actuators.

As will be appreciated by workers in the art, the actuator includes stationary and dynamic seals as are common in the art to seal the clearances between the components of the actuator and to provide efficient operation of the actuator as described herein. In particular, the clearances separating the balance piston from the mandrel and from the sleeve, that is, the top hydraulic chamber, preferably are provided with dynamic seals to prevent unintended leakage of fluid around the balance piston. The seals may be mounted on the balance piston or on the chamber as desired. For example, balance pistons 70*a* and 70*b* may be provided with annular dynamic seals (not shown), such as elastomeric O-rings mounted in grooves, on their inner surface abutting tubular sections 31*a* and 31*b* and on their outer surfaces abutting sleeves 62*a* and 62*b*, respectively. Alternatively, one or both of the seals may be mounted on the top hydraulic chambers 66*a* and 66*b*, for example, in grooves on tubular sections 31*a* and 31*b* or sleeves 62*a* and 62*b*.

As noted above, prior to actuation, the balance pistons essentially seal the top hydraulic chambers and prevent the incursion of debris. Under certain conditions, however, such as increasing downhole temperatures, pressure within the top hydraulic chambers can increase beyond the hydrostatic pressure in the well bore. The balance pistons will be urged upward until pressure in the top hydraulic chambers is equal to the is hydraulic pressure in the well bore. In the event that a balance piston "bottoms" out against the outlet port, however, pressure within the top hydraulic chamber could continue to build, possibly to the point where a diaphragm would be ruptured, thereby allowing debris laden fluid from the well bore to enter the chamber. Thus, the novel actuators preferably incorporate a pressure release device allowing release of potentially problematic pressure from the top hydraulic chamber as might otherwise occur if the balance pistons bottom out.

For example, instead of using rupturable diaphragms 73*a* and 73*b*, check valves or pressure relief valves may be mounted in passageways 72*a* and 72*b*. Such valves, if used, should also allow a desired level of fluid flow through passageways 72*a* and 72*b* during actuation. Alternately, an elastomeric burp seal (not shown) may be mounted in one or both of the clearances separating the balance pistons 70*a* and 70*b* from, respectively, tubular sections 31*a* and 31*b* and sleeves 62*a* and 62*b*. Such burp seals would then allow controlled release of fluid from top hydraulic chambers 66*a* and 66*b* to, respectively, hydraulic chambers 71*a* and 71*b* if balance pistons 70*a* and 70*b* were to bottom out against, respectively, floating pistons 61*a* and 61*b*. Such burp valves would, of course, be designed with a release pressure sufficiently below the pressure required to open the rupturable diaphragm or other normally shut valve.

Preferably, however, the pressure relief device is provided in the cylindrical mandrel. For example, a check or pressure release valve (not shown) may be mounted in tubular sections 31*a* and 31*b* so as to allow controlled release of fluid from top hydraulic chambers 66*a* and 66*b* to the interior of mandrel 30. Such an arrangement has an advantage over a burp seal as described above in that it would be necessary to overcome flow through a burp seal in order to build up sufficient pressure to rupture a diaphragm or otherwise to open a normally shut valve device. If a pressure relief device is provided in the cylindrical mandrel, pressure in the top hydraulic chamber will be equal to pressure within the interior of the mandrel, and there will be no flow through the pressure release device that must be overcome.

Figure 5A:
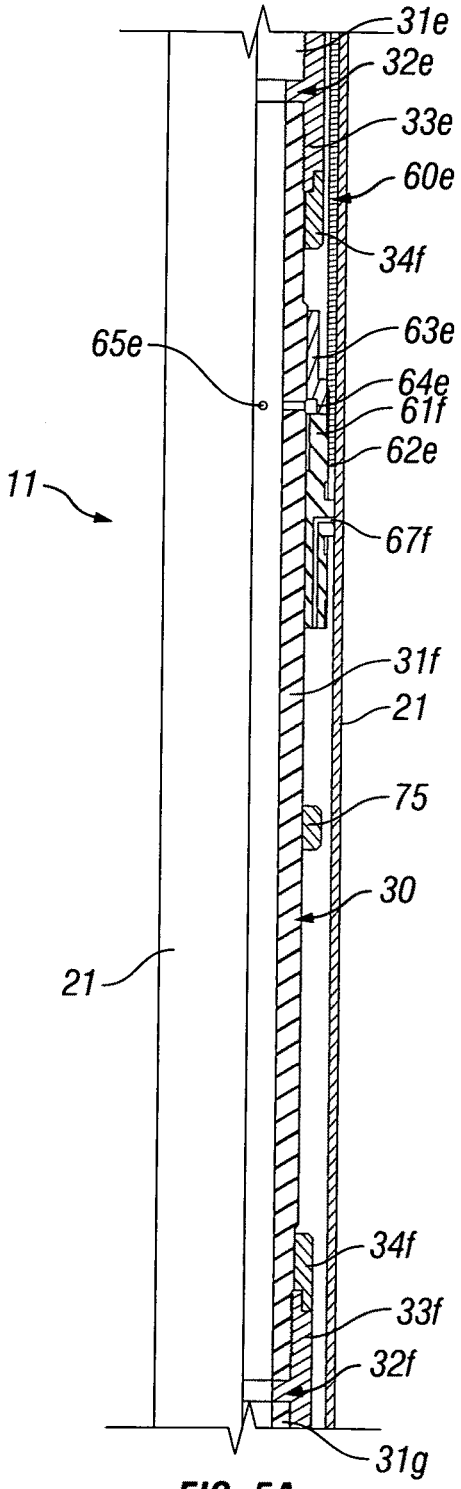
FIG. 5A is an enlarged quarter-sectional view generally corresponding to section D of tool 10 shown in FIG. 1A showing additional details of setting tool 13 and portions of liner hanger 11 in their run-in position.
Figure 5B:
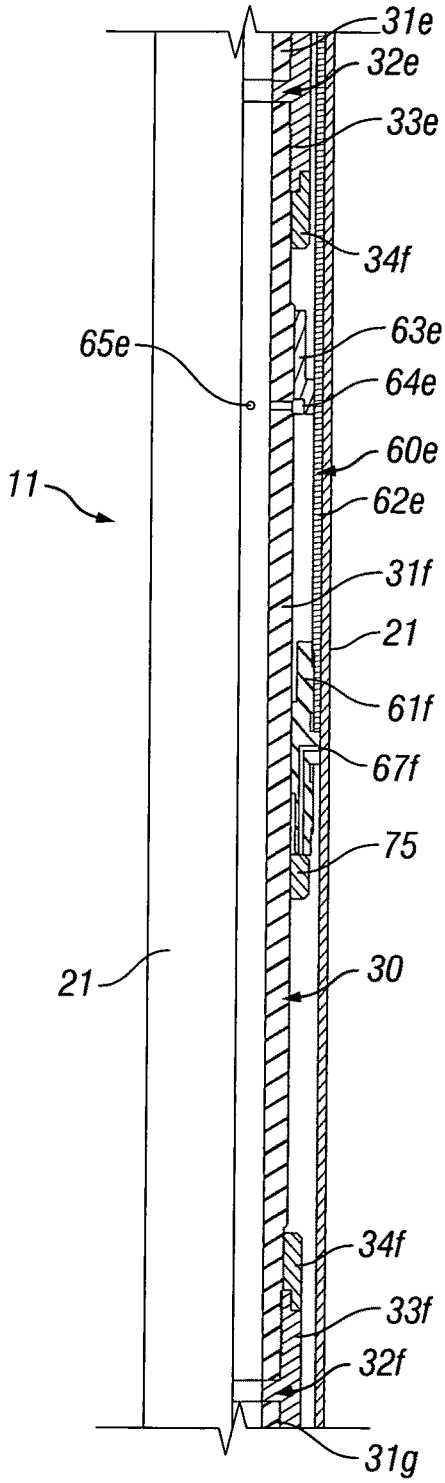
FIG. 5B is a view similar to FIG. 5A showing setting tool 13 and liner hanger 11 in their set position.

The setting assemblies of the subject invention also preferably include some means for indicating whether the swage has been fully stroked into position under the expandable metal sleeve. Thus, as shown in FIG. 5, setting tool 13 includes a slidable, indicator ring 75 supported on tubular section 31*f* just below actuator 60*e* described above. When tool 10 is in its set position, indicator ring 75 is fixed to tubular section 31*f* via a shear member, such as a screw or pin (not shown). It is positioned on section 31*f* relative to floating piston 61*f*, however, such that when floating piston 61*f* has reached the full extent of its travel, it will impact indicator ring 75 and shear the member fixing it to section 31*f*. Thus, indicator ring 75 will be able to slide freely on mandrel 30 and, when the tool is retrieved from the well, it may be readily confirmed that setting tool 13 fully stroked and set metal sleeve 22.

It will be appreciated that setting tool 13 described above provides a reliable, effective mechanism for actuating swage 21, and it incorporates novel hydraulic actuators providing significant advantages over the prior art. Thus, it is a preferred tool for use with the anchor assemblies of the subject invention. At the same time, however, there are a variety of hydraulic and other types of mechanisms which are commonly used in downhole tools to generate linear force and motion, such as hydraulic jack mechanisms and mechanisms actuated by explosive charges or by releasing weight on, pushing, pulling, or rotating the work string. In general, such mechanism may be adapted for use with the novel anchor assemblies, and it is not necessary to use any particular setting tool or mechanism to set the novel anchor assemblies.

Moreover, it will be appreciated that the novel setting assemblies, because they include hydraulic actuators having a balance piston, are able to balance hydraulic pressures that otherwise might damage the actuator and are able to keep the actuator clear of debris that could interfere with its operation. Such improvements are desirable not only in setting the anchor assemblies of the subject invention, but also in the operation of other downhole tools and components where hydraulic actuators or other means of generating linear force are required. Accordingly, the subject invention in this aspect is not limited to use of the novel setting assemblies to actuate a particular anchor assembly or any other downhole tool or component. They may be used to advantage in the setting assemblies of many other downhole tools, such as expandables, expandable liner hangers, liner hangers, whipstocks, packers, bridge plugs, cement plugs, frac plugs, slotted pipe, and polished bore receptacles (PBRs).

Operation of Anchor and Tool Assembly

The description of running tool 12 and setting tool 13 thus far has focused primarily on the configuration of those tools in their run-in position. When in its run-in position, tool 10 tool may be lowered into an existing casing, with or without rotation. If a liner is being installed, however, a drill bit preferably is attached to the end of the liner, as noted above, so that the liner may be drilled in. It also will be appreciated that tool mandrel 30 provides a conduit for circulation of fluids as may be needed for drilling or other operations in the well. Once tool 10 has been positioned at the desired depth, the liner hanger 11 will be set and released, and running tool 12 and setting tool 13 will be retrieved from the well, as now will be described in greater detail.

In general, liner hanger 11 is set by increasing the fluid pressure within mandrel 30. Increased fluid pressure actuates setting tool 13, which urges swage 21 downward and under expandable sleeve 22. At the same time, increasing fluid pressure in mandrel 30 causes a partial release of running tool 12 from mandrel 30. Once tool 10 is in this set position, running tool 12 may be released from liner hanger 11 by releasing weight on mandrel 30 through work string 14. Alternately, in the event that release does not occur, running tool 12 may be released from liner hanger 11 by rotating-mandrel 30 a quarter-turn counterclockwise prior to releasing weight.

More particularly, once tool 10 has been run in to the desired depth, liner 17 may be cemented in place. The cementing operation will allow fluid pressure to be built up within work string 14 and mandrel 30. If a cementing operation will not first be performed, for whatever reason, it will be appreciated that other means will be provided, such as a ball seat, for allowing pressure to be built up.

As fluid pressure in mandrel 30 is increased to set tool 10, fluid enters bottom hydraulic chambers 64 of actuators 60 through inlet ports 65. The increasing fluid pressure in bottom hydraulic chambers 64 urges floating pistons 61*b* through 61*f* downward. Because floating pistons 61 and sleeves 62 are all interconnected, that force is transmitted throughout all actuators 60, and whatever shear members have been employed to immobilize actuators 60 are sheared, allowing actuators 60 to begin moving downward. That downward movement in turn causes an increase in pressure in top hydraulic chambers 66 which eventually ruptures diaphragms 73, allowing fluid to flow through balance pistons 70. Continuing flow of fluid into bottom hydraulic chambers 64 causes further downward travel of actuators 60. Since fluid communication has been established in passageways 72, balance pistons 70 are urged downward along mandrel 30 with floating pistons 61, as may be seen by comparing FIGS. 2A and 2B.

Figure 3A:
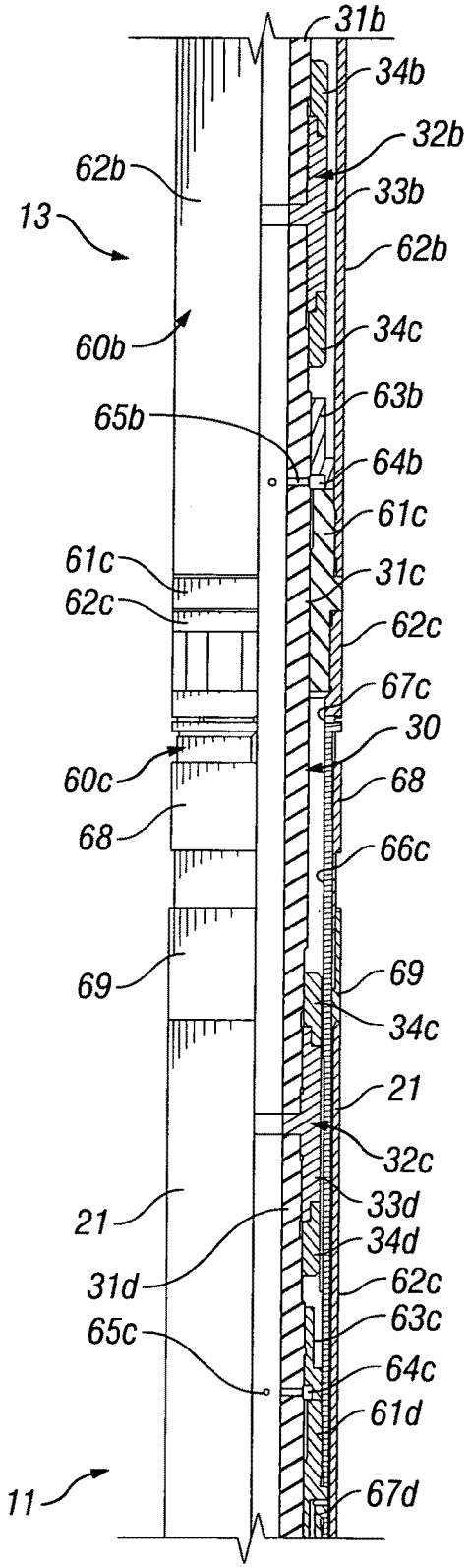
FIG. 3A is an enlarged quarter-sectional view generally corresponding to section B of tool 10 shown in FIG. 1A showing additional details of setting tool 13 and portions of liner hanger 11 in their run-in position.
Figure 3B:
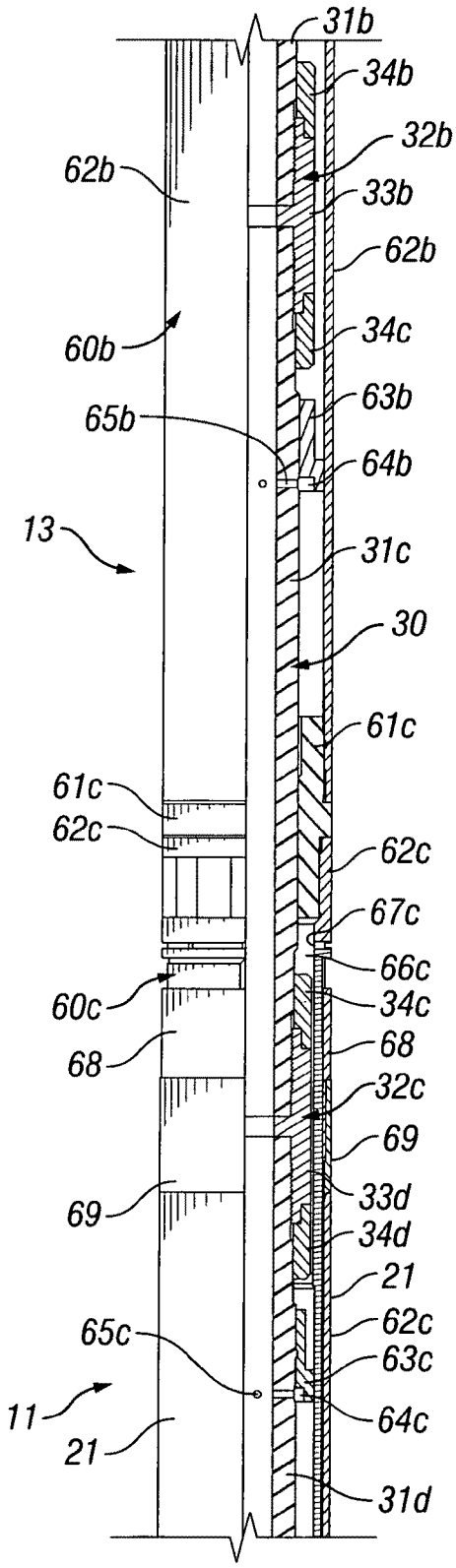
FIG. 3B is a view similar to FIG. 3A showing setting tool 13 and liner hanger 11 in their set position.

As actuators 60 continue traveling downward along mandrel 30, as best seen by comparing FIGS. 3A and 3B, the shear pins connecting adjusting collar 68 and stop collar 69 are sheared. The lower end of adjusting collar 68 then moves into engagement with the upper end of stop collar 69, which in turn abuts swage 21. Thus, downward force generated by actuators 60 is brought to bear on swage 21, causing it to move downward and, ultimately, to expand metal sleeve 22 radially outward into contact with an existing casing. It will be appreciated that ideally there is little or no movement of liner hanger 11 relative to the existing casing as it is being set. Thus, a certain amount of weight may be released on mandrel 30 to ensure that it is not pushed up by the resistance encountered in expanding sleeve 22.

Finally, as noted above, the increasing fluid pressure within mandrel 30 not only causes setting of liner hanger 11, but also causes a partial release of running tool 12 from mandrel 30. More specifically, as understood best by comparing FIGS. 6A and 6B, increasing fluid pressure in mandrel 30 causes fluid to pass through one or more ports 51 in tubular section 31*g* into a small hydraulic chamber 52 defined between locking piston 50 and annular seals 53 provided between piston 50 and section 31*g*. As fluid flows into hydraulic chamber 52, locking piston 50 is urged upward along tubular section 31*g* and away from dog housing 47.

That movement of locking piston 50 uncovers recesses in dog housing 47. As discussed above, dogs 48 are able to move radially (to a limited degree) within those recesses. Once uncovered, however, dogs 48 will be urged outward and out of engagement with tubular section 31*g* if mandrel 30 is moved downward. Thus, running tool 12 is partially released from mandrel 30 in the sense that mandrel 30, though restricted from relative upward movement, is now able to move downward relative to running tool 12. Other mechanisms for setting and releasing dogs, such as those including one or a combination of mechanical or hydraulic mechanisms, are known, however, and may be used in running tool 12.

Once liner hanger 11 has been set and any other desired operations are completed, running and setting tools 12 and 13 are retrieved from the well by first moving tool 10 to a "release" position. FIGS. 6C and 7C show the lower sections of tool 10 in their release positions. As will be appreciated therefrom, in general, running tool 12 is released from hanger 11 by releasing weight onto mandrel 30 via work string 14 while fluid pressure within mandrel 30 is reduced. Thus, as weight is released onto mandrel 30 it begins to travel downward and setting tool 13, which is held stationary by its engagement through stop collar 69 with the upper end of swage 21, is able to ride up mandrel 30.

Figure 6B:
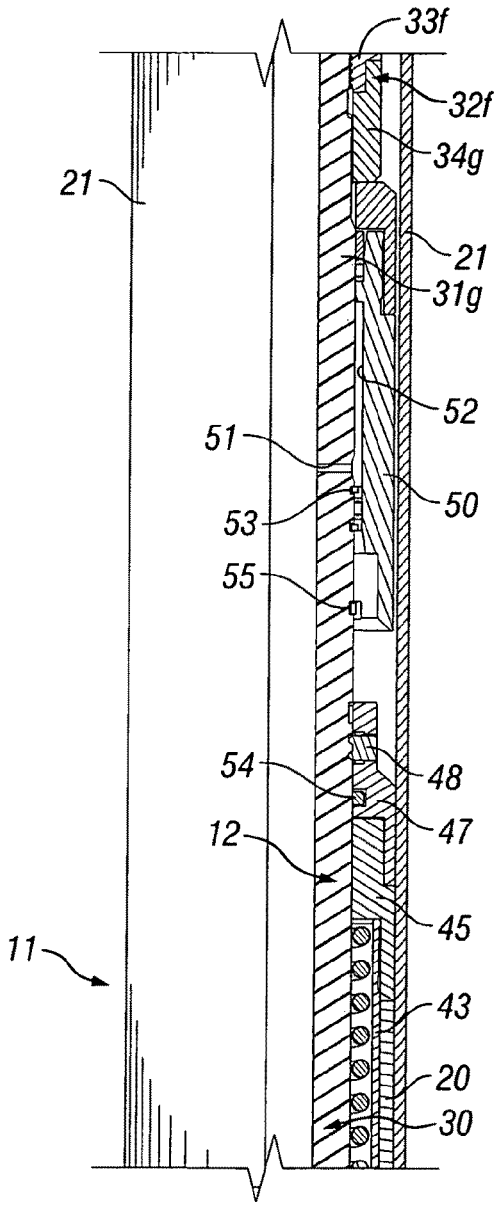
FIG. 6B is a view similar to FIG. 6A showing running tool 12 and liner hanger 11 in their set position.
Figure 6C:
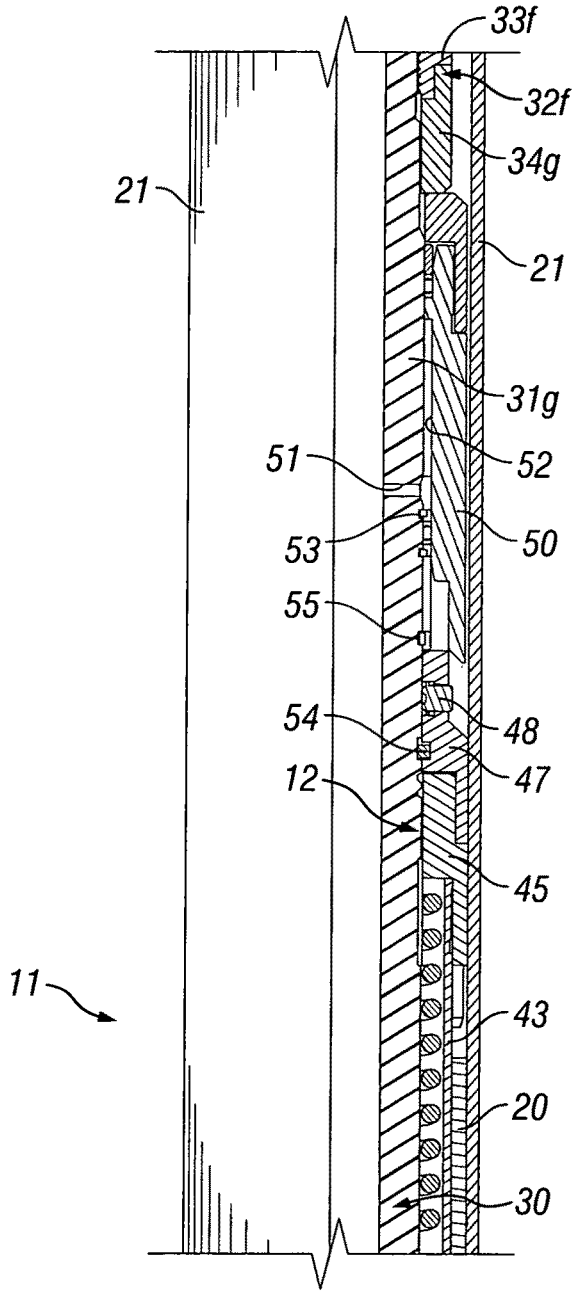
FIG. 6C is a view similar to FIGS. 6A and 6B showing running tool 12 and liner hanger 11 in their release position.

As best seen by comparing FIG. 6B and FIG. 6C, at the same time dogs 48 now are able to move radially out of engagement with tubular section 31*g* as discussed above, and as weight is released onto tool 10 mandrel 30 is able to move downward relative to running tool 12. An expanded C-ring 54 is carried on the outer surface of tubular section 31*g* in a groove in dog housing 47. As mandrel 30 travels downward, expanded C-ring 54 encounters and is able to relax somewhat and engage another annular groove in tubular section 31*g*, thus laterally re-engaging running tool 12 with tool mandrel 30. The downward travel of mandrel 30 preferably is limited to facilitate this re-engagement. Thus, an expanded C-ring and cover ring assembly 55 is mounted on tubular section 31*g* such that it will engage the upper end of dog housing 47, stopping mandrel 30 and allowing expanded C-ring 54 to engage the mating groove in tubular section 31*g*.

Finally, as best seen by comparing FIGS. 7B and 7C, downward travel of mandrel 30 will cause bottom collar 42 to travel downwards as well, thereby removing radial support for collet ends 41. Running and setting tools 12 and 13 then may be retrieved by raising mandrel 30 via work string 14. As noted, running tool 12 has been re-engaged it with tool mandrel 30. When mandrel 30 is raised, therefore, collet 40 is raised as well. Collet ends 41 are tapered such that they will be urged radially inward as they come into contact with the upper edges of annular recesses 29 in hanger mandrel 20, thereby releasing running tool 12 from hanger 11. Setting tool 13 is carried along on mandrel 30.

In the event running tool 12 is not released from mandrel 30 as tool 10 is set, it will be appreciated that it may be released by rotating mandrel 30 a quarter-turn counterclockwise and then releasing weight on mandrel 30. That is, left-handed "J" slots (not shown) are provided in tubular section 31*g*. Such "J" slots are well known in the art and provide an alternate method of releasing running tool 12 from hanger mandrel 20. More specifically, dogs 48 may enter lateral portions of the "J" slots by rotating mandrel 30 a quarter-turn counterclockwise. Upon reaching axial portions of the slots, weight may be released onto mandrel 30 to move it downward relative to running tool 12. That downward movement will re-engage running tool 12 and remove radial support for collet ends 41 as described above. Preferably, shear wires or other shear members are provided to provide a certain amount of resistance to such counterclockwise rotation in order to minimize the risk of inadvertent release.

While this invention has been disclosed and discussed primarily in terms of specific embodiments thereof, it is not intended to be limited thereto. Other modifications and embodiments will be apparent to the worker in the art.

What is claimed is:

1. A hydraulic actuator for a setting assembly of a tool for use in oil and gas wells, said hydraulic actuator comprising:

a. a cylindrical mandrel;

b. an annular stationary sealing member connected to said mandrel;

c. a hydraulic cylinder slidably supported on said mandrel and said stationary sealing member, said cylinder being releasably fixed in position relative to said mandrel;

d. said stationary sealing member dividing the interior of said cylinder into a bottom hydraulic chamber and a top hydraulic chamber;

e. an inlet port providing fluid communication into said bottom hydraulic chamber;

f. an outlet port providing fluid communication into said top hydraulic chamber;

g. an annular balance piston slidably supported within said top hydraulic chamber between said outlet port and said stationary sealing member, said balance piston comprising a passageway extending axially through said piston wherein fluid communication between the sides of said balance piston through said passageway is controlled by a normally shut valve;

h. whereby, when said cylinder is fixed in position on said mandrel, said balance piston is capable of sliding in response to a differential in hydrostatic pressure between said outlet port and said top hydraulic chamber.

2. The actuator of claim 1, wherein said balance piston is slidably supported on said mandrel.

3. The actuator of claim 1, wherein said hydraulic cylinder comprises first and second annular floating pistons slidably supported on said mandrel and a cylindrical sleeve extending between said floating pistons.

4. The actuator of claim 1, wherein said normally shut valve in said balance piston may be opened by introducing fluid into said bottom chamber and increasing the hydrostatic pressure therein.

5. The actuator of claim 4, wherein said actuator comprises a pressure release device allowing release of pressure from said top hydraulic chamber.

6. The actuator of claim 1, wherein said normally shut valve in said balance piston is a rupturable diaphragm.

7. The actuator of claim 1, wherein said actuator comprises a pressure release device allowing release of pressure from said top hydraulic chamber.

8. The actuator of claim 7, wherein said pressure release device is a burp seal mounted in the clearance between said balance piston and said top hydraulic cylinder.

9. The actuator of claim 7, wherein said pressure release device is a check valve or pressure release valve mounted in said mandrel.

10. The actuator of claim 7, wherein said pressure release device is a check valve or pressure release valve mounted in said mandrel.

11. A setting assembly for a tool for use in oil and gas wells, said setting assembly comprising the actuator of claim 1.

12. A tool for use in oil and gas wells, said tool comprising the actuator of claim 1.

13. A hydraulic actuator for generating force relative to a mandrel and actuating a tool used in oil and gas wells, said hydraulic actuator comprising:

a. a mandrel releasably connectable to a work string comprising said tool;

b. a hydraulic cylinder slidably coupled to said mandrel and having a bottom hydraulic chamber with an inlet port and a top hydraulic chamber with an outlet port;

c. wherein said cylinder is capable of axial movement relative to said mandrel from a first position to a second position, and is releasably fixed on said mandrel in said first position;

d. an annular balance piston slidably supported in said top hydraulic chamber, said balance piston dividing said top hydraulic chamber into a first portion proximate to said outlet port and a second portion remote from said outlet port, e. wherein said balance piston comprises a passageway extending through said balance piston between said first top hydraulic chamber portion and said second top hydraulic chamber portion and a valve disposed in said passageway to control fluid flow through said passageway;

f. wherein said balance piston, when said cylinder is fixed in said first position and said valve is shut, can slide in response to a differential in hydrostatic pressure between said first top hydraulic chamber portion and said second top hydraulic chamber portion; and g. wherein said cylinder, when fluid is introduced into said bottom chamber through said inlet port, said cylinder is not fixed in said first position, and said valve is open, can move from said first position to said second position and thereby generate said force.

14. The actuator of claim 13, wherein said valve in said balance piston is normally shut and may be opened by introducing fluid into said bottom chamber and increasing the hydrostatic pressure therein.

15. The actuator of claim 14, wherein said actuator comprises a pressure release device allowing release of pressure from said top hydraulic chamber.

16. The actuator of claim 15, wherein said pressure release device is a check valve or pressure release valve mounted in said mandrel.

17. The actuator of claim 15, wherein said pressure release device is a burp seal mounted in the clearance between said balance piston and said top hydraulic cylinder.

18. The actuator of claim 14, wherein said normally shut valve in said balance piston is a rupturable diaphragm.

19. The actuator of claim 13, wherein said actuator comprises a pressure release device capable of releasing pressure from said top hydraulic cylinder.

20. The actuator of claim 19, wherein said pressure release device is a burp seal mounted in a clearance between said balance piston and said top hydraulic cylinder.

21. The actuator of claim 13, wherein said balance piston is slidably supported on said mandrel.

22. The actuator of claim 13, wherein said hydraulic cylinder comprises first and second annular floating pistons slidably supported on said mandrel and a cylindrical sleeve extending between said floating pistons.

23. A setting assembly for actuating a tool for use in oil and gas wells, said setting assembly comprising the actuator of claim 13, wherein said setting assembly may be releasably coupled to said tool such that said setting assembly can actuate said tool when said actuator generates said force.

24. A tool for use in oil and gas wells, said tool comprising the actuator of claim 13, wherein said tool can be actuated by said actuator upon generation of said force.

25. A hydraulic actuator for generating force and actuating a tool used in oil and gas wells, wherein said tool may be releasably connected to a work string for running into a well bore, said hydraulic actuator comprising:

a. a mandrel;

b. a hydraulic cylinder slidably connected to said mandrel and having a bottom hydraulic chamber with an inlet port and a top hydraulic chamber with an outlet port, c. wherein said cylinder, when fluid is introduced into said bottom chamber through said inlet port, is capable of axial movement relative to said mandrel from a first position to a second position and, thereby, of generating said force and actuating said tool;

d. means for balancing the hydrostatic pressure between said top hydraulic chamber and fluid present in said well bore when said tool is run into said well bore with said cylinder fixed in said first position.

26. The actuator of claim 25, wherein said means for balancing the hydrostatic pressure is an annular balance piston slidably supported in said top hydraulic chamber, said balance piston dividing said top hydraulic chamber into a first portion proximate to said outlet port and a second portion remote from said outlet port and comprising a passageway extending through said balance piston and a normally closed valve to control fluid flow through said passageway.

27. The actuator of claim 26, wherein said actuator comprises a pressure release device allowing release of pressure from said top hydraulic chamber.

28. A tool for use in oil and gas wells, said tool comprising the actuator of claim 25, wherein said tool can be actuated by said actuator upon generation of said force.

29. A tool for use in oil and gas wells, said tool comprising the actuator of claim 14, wherein said tool can be actuated by said actuator upon generation of said force.

30. A tool for use in oil and gas wells, said tool comprising the actuator of claim 19, wherein said tool can be actuated by said actuator upon generation of said force.

31. A tool for use in oil and gas wells, said tool comprising the actuator of claim 15, wherein said tool can be actuated by said actuator upon generation of said force.

* * * * *